US010475359B2

(12) United States Patent
Lee

(10) Patent No.: US 10,475,359 B2
(45) Date of Patent: Nov. 12, 2019

(54) LED MATRIX LIGHTING DEVICE

(71) Applicant: Bitro Group, Inc., Hackensack, NJ (US)

(72) Inventor: Ki S. Lee, Palisades Park, NJ (US)

(73) Assignee: Bitro Group, Inc., Hackensack, NJ (US)

( * ) Notice: Subject to any disclaimer, the term of this patent is extended or adjusted under 35 U.S.C. 154(b) by 0 days.

(21) Appl. No.: 15/860,034

(22) Filed: Jan. 2, 2018

(65) Prior Publication Data

US 2018/0122278 A1 May 3, 2018

Related U.S. Application Data

(63) Continuation of application No. 14/460,603, filed on Aug. 15, 2014, now Pat. No. 9,865,185.

(60) Provisional application No. 61/866,287, filed on Aug. 15, 2013.

(51) Int. Cl.
*G09F 13/22* (2006.01)

(52) U.S. Cl.
CPC ..... *G09F 13/22* (2013.01); *Y10T 29/4913* (2015.01)

(58) Field of Classification Search
CPC ..... G09F 13/22
USPC ..... 362/235
See application file for complete search history.

(56) References Cited

U.S. PATENT DOCUMENTS 7,880,831 B2 * 2/2011 Hsiao ..... G02F 1/133608 349/70
9,797,559 B2 10/2017 Sellam
2003/0112627 A1 * 6/2003 Deese ..... F21V 21/0832 362/249.01
2004/0233671 A1 * 11/2004 Staufert ..... H01L 25/0753 362/294
2005/0221659 A1 * 10/2005 Mrakovich ..... F21V 21/002 439/404
2007/0002590 A1 * 1/2007 Jang ..... G02F 1/133603 362/633
2008/0100773 A1 * 5/2008 Hwang ..... G02B 3/005 349/62
2008/0259240 A1 * 10/2008 Song ..... G02F 1/133608 349/62
2009/0267533 A1 * 10/2009 Lee ..... G09F 9/33 315/294
2010/0220046 A1 * 9/2010 Plotz ..... F21K 9/00 345/102

(Continued)

OTHER PUBLICATIONS

Bitro Group Inc., "The Lattice, LED Carpet Matrix Lighting System for Sign Cabinets and Large Light Boxes", copyright 2010.

(Continued)

*Primary Examiner* — Bryon T Gyllstrom
(74) *Attorney, Agent, or Firm* — Myers Wolin, LLC

(57) ABSTRACT

One embodiment of a light emitting diode (LED) lighting device comprises multiple LED light sources disposed on multiple elongated circuit boards, with each LED light source being electrically connected to one of the circuit boards. The elongated circuit boards are electrically coupled using electrical passageways to provide power to the circuit boards at intervals along the length of the elongated circuit boards, and the light sources disposed on the circuit boards emit light in the same direction perpendicular to the elongated circuit boards. The electrical passageways can be wires or groups of wires.

18 Claims, 33 Drawing Sheets

(56) References Cited

U.S. PATENT DOCUMENTS

| | | | | |
|---|---|---|---|---|
| 2011/0019413 | A1* | 1/2011 | Zimmerman | G09F 13/22 362/249.02 |
| 2012/0063133 | A1* | 3/2012 | Takeuchi | G02F 1/133603 362/235 |
| 2012/0212682 | A1* | 8/2012 | Kuromizu | G02B 3/08 348/739 |

OTHER PUBLICATIONS

Bitro Group Inc., "The Lattice LED Carpet System", copyright 2010.

Non-Final Office Action issued by the USPTO for co-pending U.S. Appl. No. 14/460,603 dated May 5, 2017.

* cited by examiner

LED MATRIX LIGHTING DEVICE

CROSS-REFERENCE TO RELATED APPLICATIONS

This application is a continuation of U.S. application Ser. No. 14/460,603 filed Aug. 15, 2014 which claims the benefit of U.S. Provisional Application No. 61/866,287, filed Aug. 15, 2013, the contents of each are incorporated by reference herein.

FIELD OF THE INVENTION

This disclosure relates to an LED matrix lighting device for providing substantially even lighting across a large area.

BACKGROUND

Often, it is desirable to evenly light a large surface area. This is required, for example, when backlighting a light box for displaying a poster or the like. Traditionally, these types of lighting applications have used fluorescent light bulbs or a large number of LED light sources fixed to a surface containing necessary circuitry. Fluorescent bulbs tend to light such surfaces unevenly, and existing LED assemblies require a substantial amount of material for fixing LED light sources and circuitry in place. Additionally, they are often resource intensive in terms of materials, installation, preparation, and fixation of electrical connections.

Some lightweight assemblies designed to address these issues exist, but contain issues with consistent production, quality control during assembly, and a lack of redundant electrical connections for securing electrical connectivity. Further, it is easy to make damaging mistakes during installation of such assemblies.

Existing assemblies are often limited to a single color of LED light sources. Further, existing assemblies are often difficult to install. Existing installation contingencies are limited, and installation therefore often requires substantial time and effort.

There is a need for a lightweight, easy to install LED lighting device that allows a user to easily place an array of LED light sources across a large area while providing even lighting. There is a further need that such an LED lighting device be robust, provide a variety of installation methods, allow for full color installations, and allow for consistent and efficient production.

SUMMARY

In one embodiment, there is provided a light emitting diode (LED) lighting device comprising a plurality of LED light sources disposed on multiple elongated circuit boards, with each LED light source being electrically connected to one of the circuit boards. The elongated circuit boards are electrically coupled using electrical passageways to provide power to the circuit boards at intervals along the length of the elongated circuit boards, and the light sources disposed on the circuit boards emit light in the same direction perpendicular to the elongated circuit boards. The electrical passageways can be wires or groups of wires.

The elongated circuit boards may be electrically coupled to the electrical passageways using electrically conductive screws, pins, or solder that passes through the circuit board and connects a portion of an electrically conductive layer to an electrical wire on the opposite side of a substrate of the circuit board.

The elongated circuit boards may be single sided printed circuit board (PCB) and may be provided with a first electrical passageway to provide an anode and a second electrical passageway to provide a cathode.

In some embodiments the electrical passageways are a plurality of wires for providing multiple cathodes or anodes for connecting to different LED light sources on different circuit boards, or for activating different colors in the LED light sources.

In some embodiments the LED lighting device further comprises mounting elements for fixing the electrical passageways to the elongated circuit boards, and for fixing the assembly to a wall, track, or tensioned cable for mounting.

In some embodiments, the LED lighting device is assembled using a jig to apply mounting elements to the elongated circuit boards at consistent intervals.

DETAILED DESCRIPTION OF THE PREFERRED EMBODIMENTS

Figure 1:
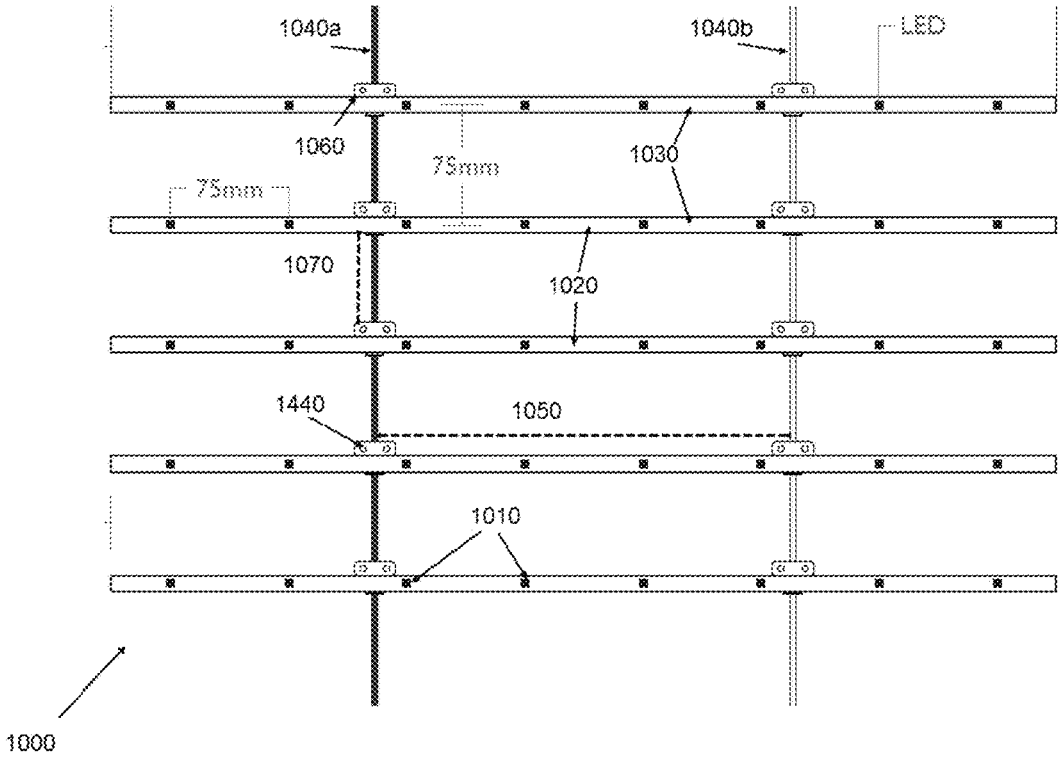
FIG. 1 is a generic embodiment of a light emitting diode (LED) lighting device according to the disclosure.

The description of illustrative embodiments according to principles of certain embodiments is intended to be read in connection with the accompanying drawings, which are to be considered part of the entire written description. In the description of certain embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of certain embodiments are illustrated by reference to the exemplified embodiments. Accordingly, every embodiment expressly should not be limited to such exemplary embodiments illustrating some possible non-limiting combination of features that may exist alone or in other combinations of features.

This disclosure describes the best mode or modes of practicing certain embodiments as presently contemplated. This description is not intended to be understood in a limiting sense, but provides examples solely for illustrative purposes by reference to the accompanying drawings to advise one of ordinary skill in the art of the advantages and construction of certain embodiments. In the various views of the drawings, like reference characters designate like or similar parts.

FIG. 1 shows a generic embodiment of a light emitting diode (LED) lighting device 1000. The LED lighting device 1000 may be used to provide a plane of relatively even lighting, and may be placed, for example, within an LED light box to backlight a surface or image. Alternatively, the LED lighting device 1000 may be applied in any other situation where a substantially even distribution of light emitting diodes is desired.

The LED lighting device of the illustrated embodiment comprises a plurality of LED light sources 1010 disposed on two or more elongated circuit boards 1020. Each LED light source 1010 is electrically connected to one of the two or more elongated circuit boards 1020. In the embodiment shown, each LED light source 1010 is disposed on a surface 1030 of one of the two or more elongated circuit boards 1020, and each LED light source 1010 distributes light in a direction substantially perpendicular to the surface 1030 on which it is disposed. The two or more elongated circuit boards 1020 are printed circuit boards (PCBs), with each of the PCBs electrically coupled to other PCBs by a plurality of electrical passageways 1040 at intervals 1050 along its length. Preferably, the elongated circuit boards 1020 have a width of 11 mm or less.

In the embodiment shown, the elongated circuit boards 1020 are electrically coupled by two electrical passageways 1040*a* and 1040*b*, each of which carries an electrical current or voltage and connects to circuitry on each elongated circuit board 1020 to which it is electrically coupled. In some embodiments, the LED lighting device comprises more than two elongated circuit boards 1020, and the plurality of electrical passageways 1040 selectively electrically couples the elongated circuit boards 1020, such that different electric currents or voltages are provided to different elongated circuit boards. In some embodiments, the electrical passageways 1040 carry a plurality of sub-passageways, such as individual wires, with different wires carrying different currents or voltages. In such embodiments, some elongated circuit boards 1020 may be selectively coupled to some sub-passageways but not others within each electrical passageway 1040. Some such embodiments are discussed more fully below.

In certain embodiments each electrical passageway 1040 is mechanically coupled to each elongated circuit board 1020 at a mounting element 1060, and each mounting element is configured to be either removably or permanently fixed to both an elongated circuit board 1020 and an electrical passageway 1040. When assembled, mounting elements 1060 are fixed at locations at intervals 1050 along the length of each elongated circuit board 1020 and intervals 1070 along the length of each electrical passageway 1040.

When assembled, the LED lighting device 1000 may provide LED light sources 1010 substantially evenly spaced across a grid, such that each LED light source, other than those at an end of an elongated circuit board 1020, is equidistant from its neighboring LED light sources along the elongated circuit board. Similarly, each LED light source 1010 is the same distance from any neighboring LED light sources on a neighboring elongated circuit board 1020 to which the corresponding elongated circuit board is coupled to by an electrical passageway 1040. In alternate embodiments, the distance between LED light sources 1010 on a single elongated circuit board 1020 is different than the distance between LED light sources 1010 on different elongated circuit boards.

Figure 2A:
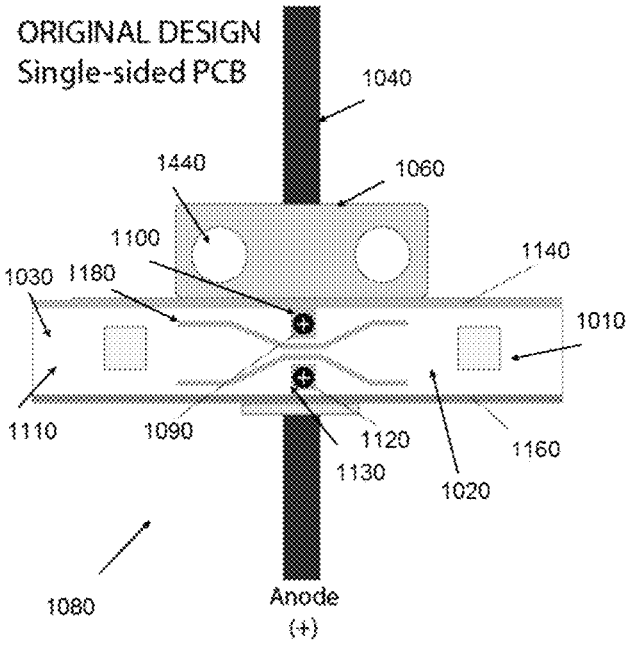
FIGS. 2A-D show segmented portions of embodiments of an LED lighting device according to the disclosure.

FIG. 2A shows a segmented portion 1080 of an embodiment of an LED lighting device 1000. Two LED light sources 1010 are shown on a segment of a single elongated circuit board 1020 with a single electrical passageway 1040 connected to the elongated circuit board 1020 at a mounting element 1060. Also shown are two connections 1090, 1120 between the elongated circuit board 1020, the electrical passageway 1040, and the mounting element 1060.

A first screw 1090 is both an electrical and mechanical connection, fixing the mounting element 1060 mechanically to the elongated circuit board 1020 and electrically to the electrical passageway 1040. In a preferred embodiment, the first screw 1090 is of an electrically conductive material, such as a conductive metal, and is in electrical contact with both the electrical passageway 1040 and a first portion 1100 of an electrically conductive layer 1110 on the elongated circuit board 1020. It will be understood that the electrical and mechanical connections need not be a screw, but may be any other element or groupings of elements, such as clips, welds, or other connections that may combine to connect the electrical passageway 1040 mechanically and electrically to the elongated circuit board 1020.

A second screw 1120 fixes the mounting element 1060 mechanically to the elongated circuit board 1020. In the embodiment shown, the second screw 1120 is connected in a similar fashion as the first screw 1100, and electrically connects the electrical passage 1040 to a second portion 1130 of the electrically conductive layer 1100. It will be understood that this electrical connection is unnecessary, and that other embodiments may not contain such a connection. Similarly, the screw may be replaced by other elements that can mechanically fix the elongated circuit board 1020 to the mounting element 1060. In other embodiments, a second screw 1120 is unnecessary, and the stability of the segment 1080 of the LED lighting device 1000 may be ensured by the first screw 1090 or any fixation elements replacing the first screw or second screw.

Circuitry 1180 (shown only generally) is disposed on, or near, the surface 1030 of the elongated circuit board 1020 and lies between a parallel anode 1140 and cathode 1160. The circuitry may be a third portion of the electrically conductive layer 1110 of the elongated circuit board 1020.

The electronic circuit board 1020 of the embodiment is a single sided PCB, having a single electrically conductive layer 1110. The circuitry 1180 electrically connects the anode 1140, each of the LED light sources 1010 on the surface 1030 of the elongated circuit board 1020, and the cathode 1160. Current may then flow from the anode 1140 through the LED light sources 1010 and to the cathode 1160 to provide power to the LED light sources. In the embodiment shown, the circuitry 1180 may pass between the first screw 1090 and the second screw 1110, such that a single circuit may power all LED light sources 1010 along the length of the elongated circuit board 1020. Such a single circuit may be provided with redundancies, and may connect to the Anode and Cathode in multiple places.

It will be understood that while the segment 1080 shown illustrates the connection between the elongated circuit board 1020 and the electrical passageway 1040 and provides a positive current or voltage to the anode 1140, a separate segment of such an embodiment may have equivalent circuitry such that an electrical connection is made to the cathode 1160.

Figure 2B:
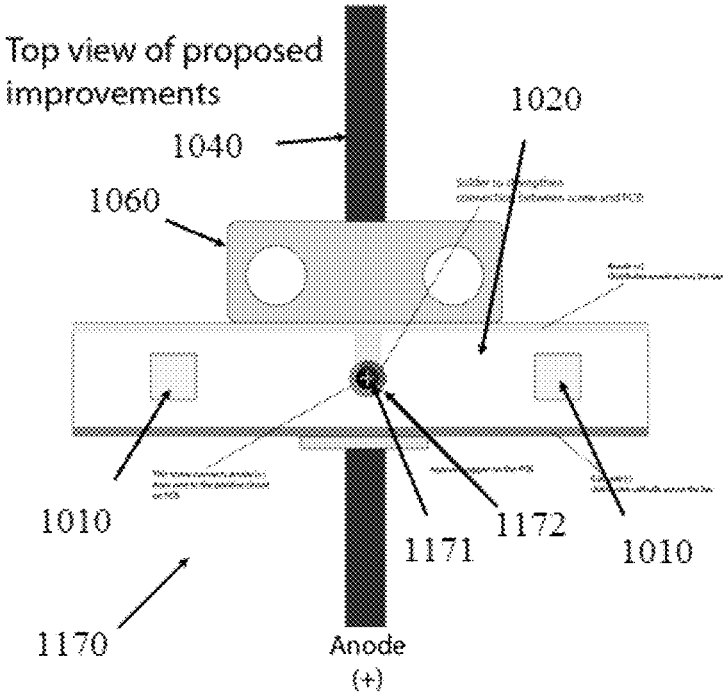
Figure 2C:
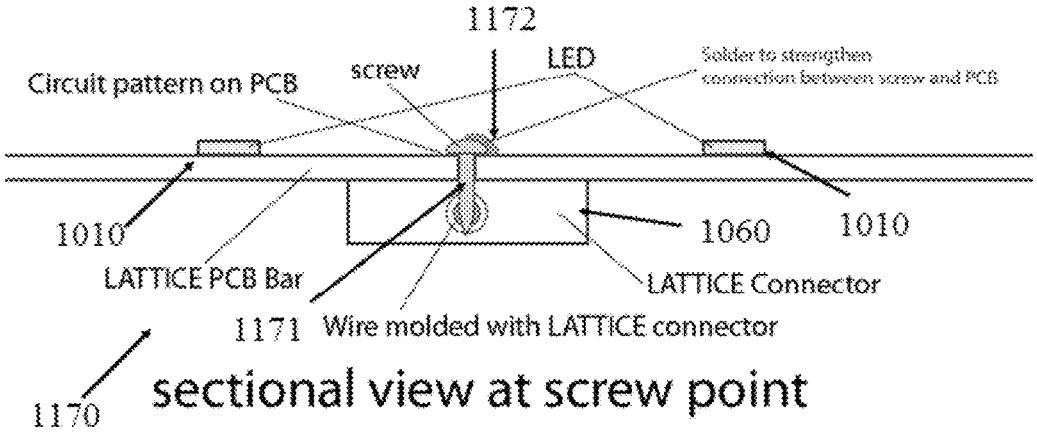

FIGS. 2B-C show a segmented portion 1170 of an alternative embodiment of the LED lighting device 1000. Two LED light sources 1010 are shown on a segment of a single elongated circuit board 1020 with a single electrical passageway 1040 connected to the elongated circuit board at a mounting element 1060. In the embodiment shown, a single screw 1171 provides both electrical and mechanical connections to the elongated circuit board 1020. Instead of reinforcing the mechanical connection with a second screw, the connection is reinforced by applying solder 1172 on top of and around the edge of the screw. This strengthens the mechanical connection and renders it permanent, and can provide electrical redundancy in the connection between the screw and the circuitry on the surface of the elongated circuit board 1020 as well.

The connections shown in FIGS. 2B-C can be implemented in a single connection as shown, or solder 1172 can be used to reinforce a variety of embodiments of the LED lighting device 1000, including when multiple screws are used for each connection.

Figure 2D:
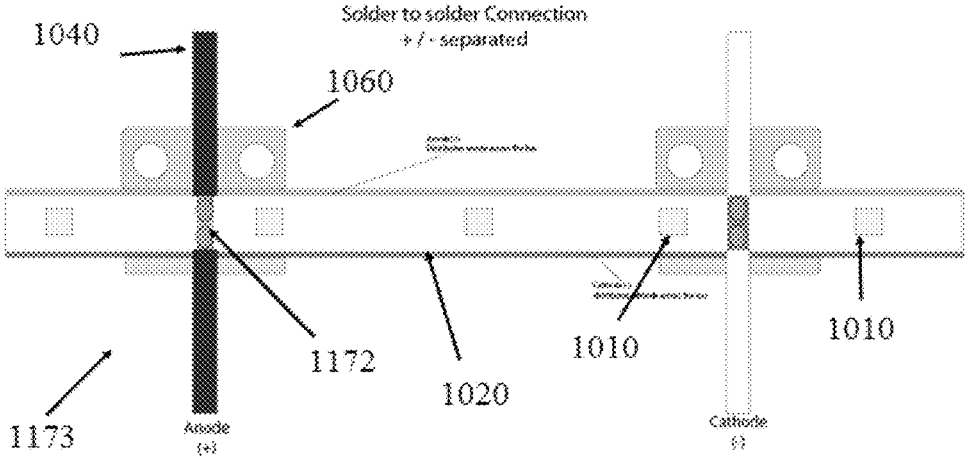

FIG. 2D shows a segmented portion 1173 of an alternative embodiment of the LED lighting device 1000. In the embodiment shown, solder 1172 is used in place of screws as both an electrical and mechanical connection. In these embodiments, solder 1172 may be applied using through-hole soldering techniques or other solder-to-solder methods. These methods may be applied to various configurations of the LED lighting device 1000, including those discussed below, to connect any number of wires at each electrical passageway in the assembly.

In these embodiments, a plastic cover can be placed on top of the PCB and the solder points to protect and cover the solder points. Silicone, epoxy, and other conformal materials can be used to create weather protection around the solder points.

Figure 3A:
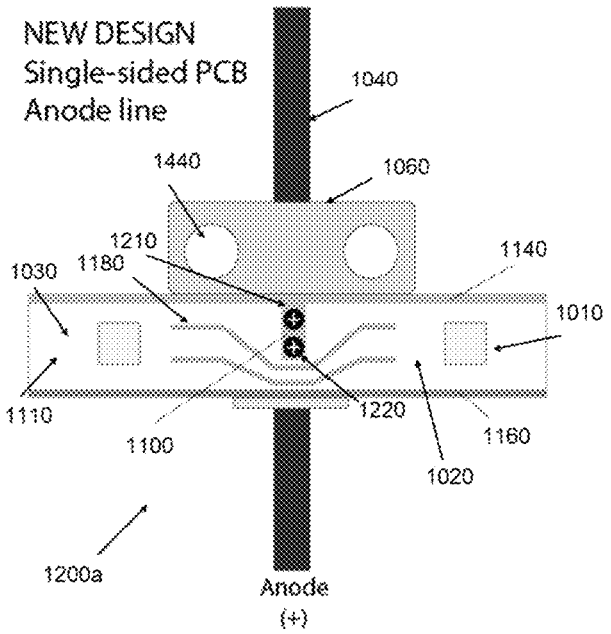
FIGS. 3A-B show segmented portions and of an embodiment of an LED lighting device according to the disclosure.
Figure 3B:
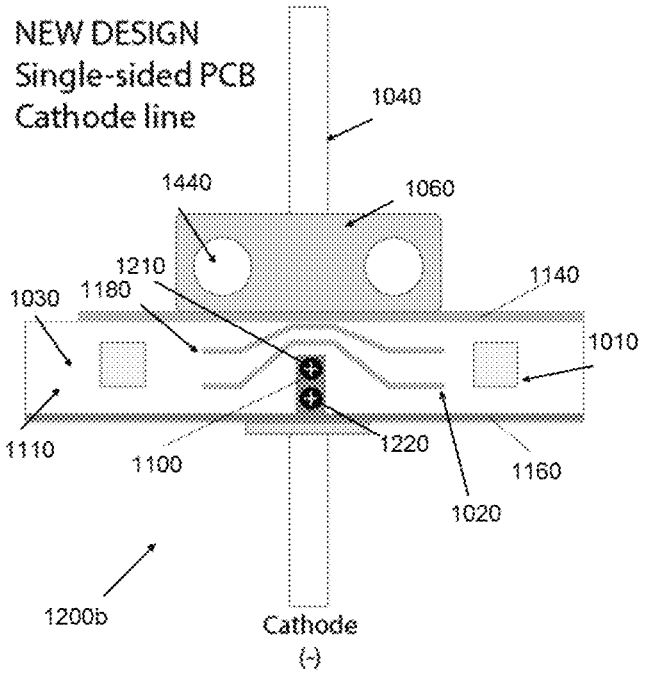

FIGS. 3A and 3B show segmented portions 1200A and 1200B of an embodiment of an LED lighting device 1000. As in the embodiment of FIG. 2A, there are two connections, a third screw 1210, and a fourth screw 1220 between the elongated circuit board 1020, the electrical passageway 1040, and the mounting element 1060.

The embodiment shown differs from that of FIG. 2A, in that the screws 1210, 1220 are both electrical and mechanical connections, fixing the elongated circuit board 1020 mechanically to the mounting element 1060 and electrically to the electrical passageway 1040. In a preferred embodiment, the screws 1210, 1220 are both of an electrically conductive material, such as a conductive metal, and are in electrical contact with both the electrical passageway 1040 and a first portion 1100 of an electrically conductive layer 1110 on the elongated circuit board 1020.

Because both screws 1210, 1220 are in electrical contact with the electrical passageway 1040, an electrical redundancy is formed such that if either of the connections formed using the screws 1210, 1220 are broken, a secondary connection remains. The first portion 1100 of the electrically conductive layer 1110 is electrically connected to the anode 1140 or cathode 1160, providing a positive or negative current or voltage to circuitry 1180. It will be understood that while segment 1200A illustrates the connection between the elongated circuit board 1020 and the electrical passageway 1040 and provides a positive current or voltage to the anode 1140, a separate segment 1200B of the embodiment will have equivalent circuitry such that an electrical connection is made to the cathode 1160.

As in the embodiment of FIG. 2A, Circuitry 1180 is disposed on, or near, the surface 1030 of the elongated circuit board 1020 and lies between the parallel anode 1140 and cathode 1160.

The electronic circuit board 1020 of the embodiment is a single sided PCB, having a single electrically conductive layer 1110. The circuitry 1180 electrically connects the anode 1140, each of the LED light sources 1010 on the surface 1030 of the elongated circuit board 1020, and the cathode 1160. Current may then flow from the anode 1140 through the LED light sources 1010 and to the cathode 1160 to provide power to the LED light sources. In the embodiment shown, the circuitry 1180 may pass between the pair of screws 1210, 1220, and the cathode 1160, such that a single circuit may power all LED light sources 1010 along the length of the elongated circuit board 1020. Similarly, where an electrical connection is made between an electrical passageway 1040 and a cathode 1160, the circuitry may pass between an equivalent pair of screws and the anode 1140. Such a single circuit may be provided with redundancies, and may connect to the Anode 1140 and Cathode 1160 in multiple places.

Figure 4:
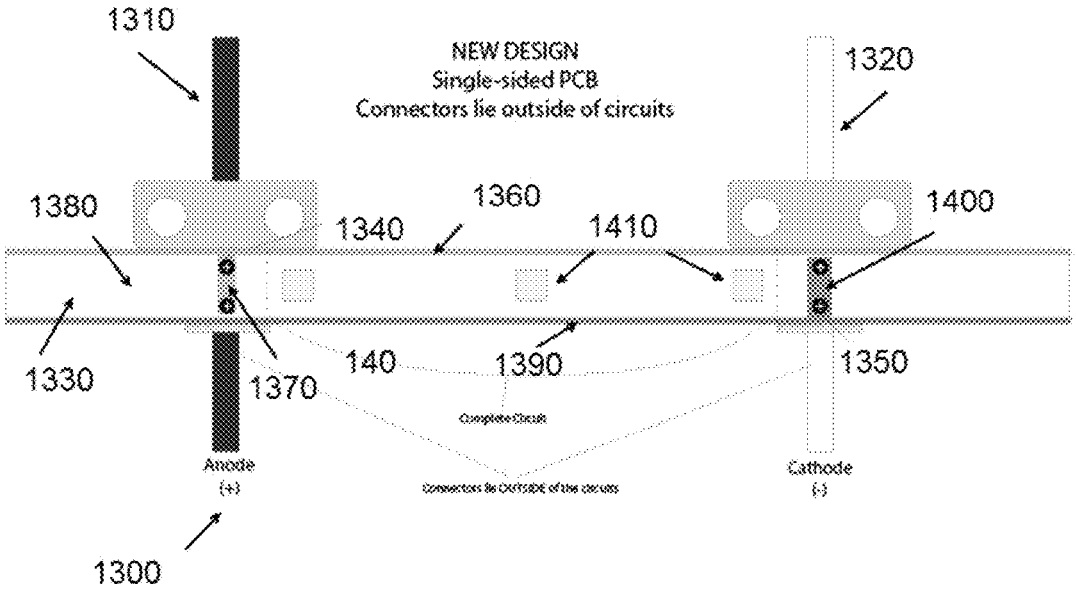
FIG. 4 shows a segmented portion of an alternative embodiment of an LED lighting device according to the disclosure.

FIG. 4 shows a segmented portion 1300 of an alternative embodiment of an LED lighting device 1000. The segmented portion 1300 includes a first electrical passageway 1310 and a second electrical passageway 1320 fixed to an elongated circuit board 1330 by a first pair of screws 1340 and a second pair of screws 1350 respectively. The first pair of screws 1340 provides a current or voltage to an anode 1360 by electrically connecting the first electrical passageway 1310 to a first portion 1370 of a conducting layer 1380. The second pair of screws 1350 electrically connects a cathode 1390 to the second electrical passageway 1320 via a second portion 1400 of the conducting layer.

In the embodiment shown, three LED light sources 1410 are disposed on a surface 1420 of the elongated circuit board 1330, and are powered by circuitry (not shown) disposed on or near the surface of the elongated circuit board. The elongated circuit board is a single sided PCB, with all circuitry providing power to the LED light sources 1410 lying on or near the surface of the PCB between the anode 1360, the cathode 1390, the first portion 1370 of the conducting layer 1380 and the second portion 1400 of the conducting layer.

The device of FIG. 1 incorporates mounting elements 1060 for mounting the LED lighting device 1000. The mounting elements 1060 are fixed, either permanently or removably, to the elongated circuit boards 1020 at regular intervals along the length of each elongated circuit board, and are fixed at regular intervals 1050 along the length of each electrical passageway 1040 at regular intervals 1070 Using the mounting elements 1060, the device 1000 may be fixed using nails or screws or other fixation devices to fix the mounting elements to a surface external to the device at the mounting holes 1440 in the mounting element. In some embodiments, rather than using the mounting holes 1440, the mounting elements 1060 are fixed to the surface using an adhesive fixed to the back surface of the mounting element, or some other fixation device. Additional details related to mounting the LED lighting device 1000 using the mounting elements are provided in FIGS. 5-19.

Figure 5:
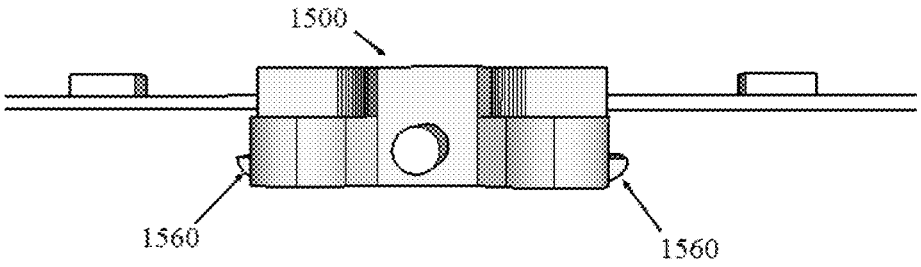
FIGS. 5-7 show a mounting element and associated mounting rails in accordance with one embodiment of the LED lighting device.
Figure 6:
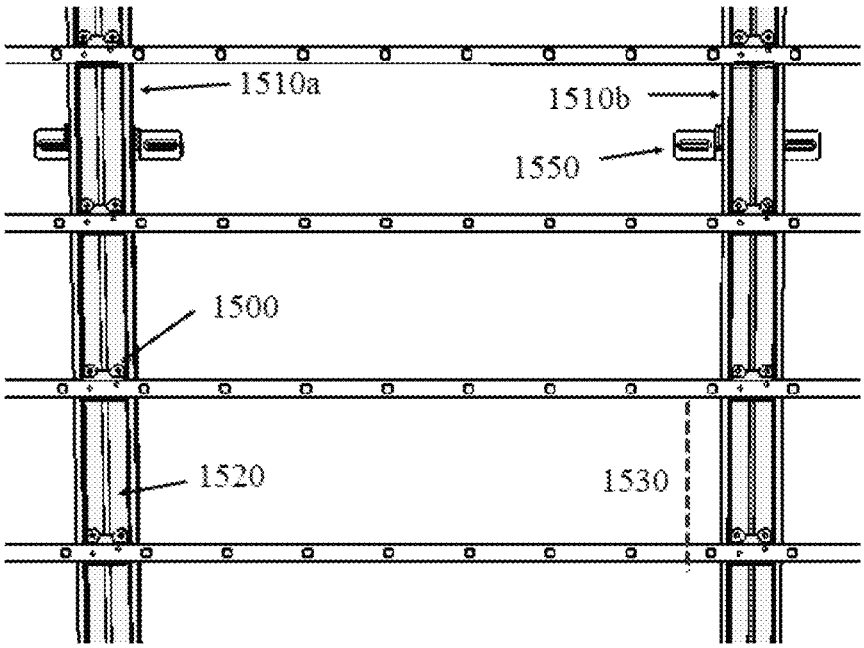
Figure 7:
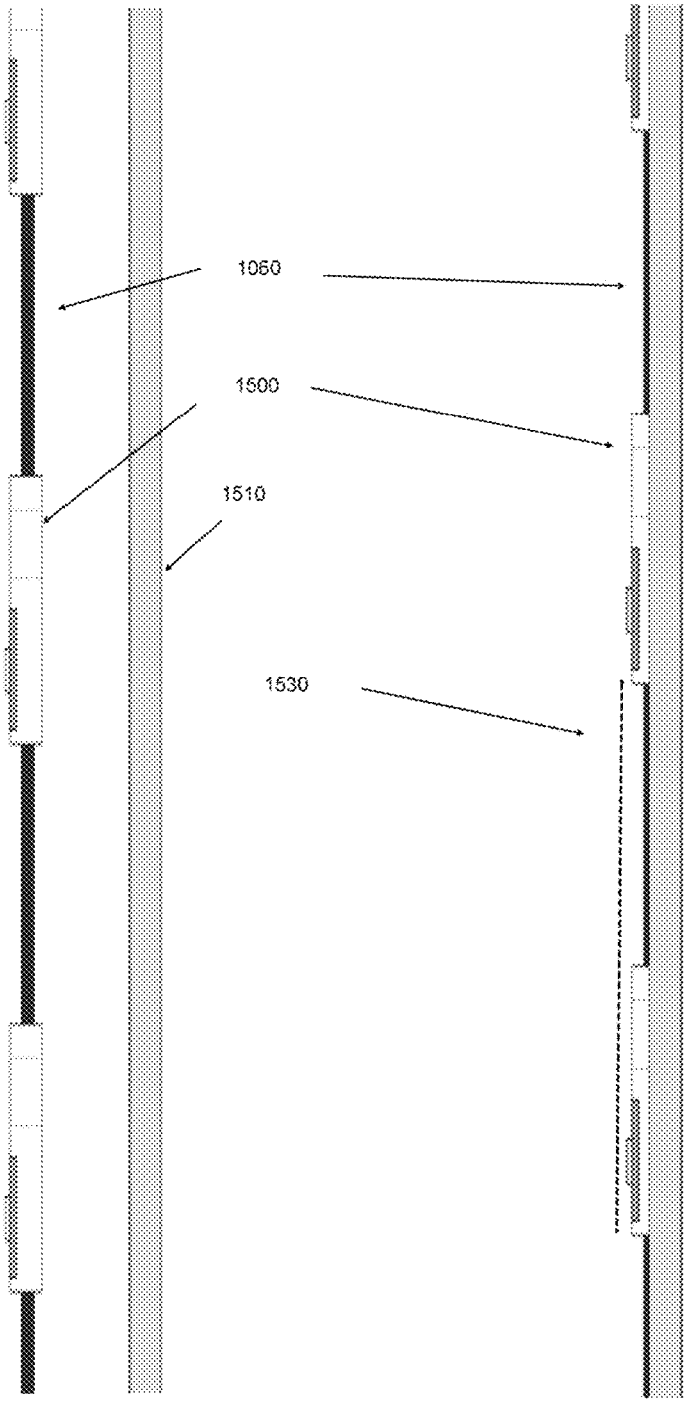

FIGS. 5-7 show a mounting element 1500 and an associated at least two mounting rails 1510 in accordance with one embodiment of the LED lighting device. The mounting rails 1510 provide a track 1520 for engaging each of the mounting elements 1500. Each mounting rail 1510 may be, for example, a strip of extruded material, such as metal. Alternatively, the mounting rails 1510 may be molded, or formed by some other manufacturing process. The mounting rails 1510 may, for example, be extruded as a single strip and then cut to length for a specific application.

Each mounting rail 1510 may contain a channel for retaining the individual mounting elements, which may, for example, have a T shaped cross-section, with the T formed by a back surface, two side walls extending from the back surface, and two front surfaces extending from the two side surfaces respectively. The channel may then securely retain some portion of the mounting elements 1500 such that a remaining portion of the mounting element may extend from between the two front surfaces (forming the leg of the T shaped cross section) and be fixed to the elongated circuit boards 1020.

In some embodiments, the mounting elements 1500 may contain connectors, or wings 1540, designed to be retained by the cross section of the channel of the mounting rails 1510.

Each mounting rail 1510 may contain a single channel running the length of the rail. Installation of such a system may then be performed by first mounting a pair of mounting rails 1510 substantially parallel to each other on an external surface using, for example, mounting holes in the rail 1510 or wall mounts 1550 mounted on the rails. Alternatively, the mounting rails 1510 may be installed using alternative fixation elements or adhesives, much as the mounting elements 1060 of earlier embodiments were mounted. Once both mounting rails 1510 are installed, at least two elongated circuit boards 1020, each of which have at least two mounting elements 1500 having wings 1540 are provided. The mounting elements 1500 are then inserted consecutively into the channels of the two mounting rails 1510 such that the wings 1540 are retained by the T shaped cross section of each channel and such that electrical passageways 1040 linking the mounting elements 1500 are substantially parallel to the corresponding channel. Once installed, the mounting elements 1500 are retained at intervals 1530 along the electrical passageways 1040 within the channels, and each of the elongated circuit boards 1020 is maintained substantially perpendicular to the two mounting rails 1510 and substantially parallel to each other.

In some embodiments, there are gaps in the two front surfaces of each mounting rail 1510 such that mounting elements 1500 may be inserted at the gaps and shifted such that they are retained by the channels. Mounting rails may then be installed parallel to each other such that each mounting rail 1510 has gaps at corresponding locations. The gaps may be at the intervals 1070 along the electrical passageway 1040, and the mounting elements may then be installed by simultaneously inserting each mounting element into a corresponding gap and shifting the entire assembly slightly such that each mounting element is retained by the channels.

It will be understood that various installation procedures may be applied for installing the mounting rails and the remainder of the LED lighting device 1000. An installer may, for example, first insert mounting elements within the channels of the mounting rails and then later mount the mounting rails on an external surface.

Figure 8:
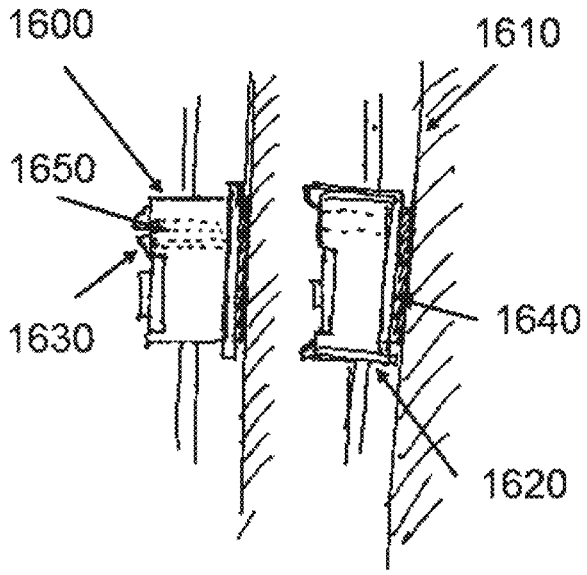
FIGS. 8-9 show alternative embodiments of mounting elements and systems for mounting the LED lighting device.
Figure 9:
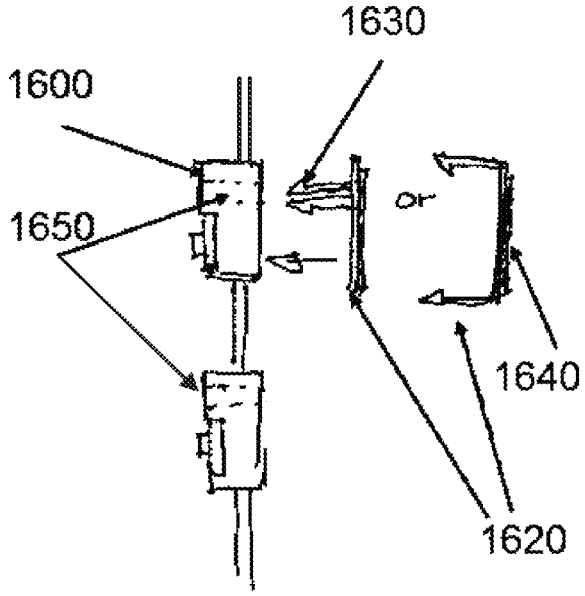

FIGS. 8 and 9 show alternative embodiments of mounting elements 1600 and systems for mounting the LED lighting device on an external surface 1610. In the embodiments shown, a plurality of clips 1620 are provided, and are configured with at least one tab 1630 for engaging with one of mounting elements 1600 and at least one fixation surface 1640 for fixing to the external surface 1610 in any of the manners discussed above in reference to the mounting elements 1060. Each clip 1620 may then be fixed to external surface 1610 at the fixation surface 1640 prior to mounting the rest of the LED lighting device 1000. Once mounted, each clip 1620 may then be mated to a corresponding mounting element 1600 at the at least one tab 1630. The tabs 1630 may be spring loaded tabs for grasping outer edges of the mounting elements 1600, or alternatively, may be spring loaded tabs for mating with a mounting hole 1650 of the corresponding mounting element 1600.

It will be understood that other arrangements may be provided for fixing the mounting elements 1600 to the clips 1620 provided. In some embodiments, the LED lighting device 1000 may be provided with fewer clips 1620 than mounting elements 1600, and only certain mounting elements may require fixation to clips in order to securely mount the device 1000. The device 1000 may, for example, be mounted only at extremities of the LED lighting device in embodiments where more than two elongated circuit boards 1020 are provided and/or more than two mounting elements 1600 are provided for each elongated circuit board 1020.

Figure 10:
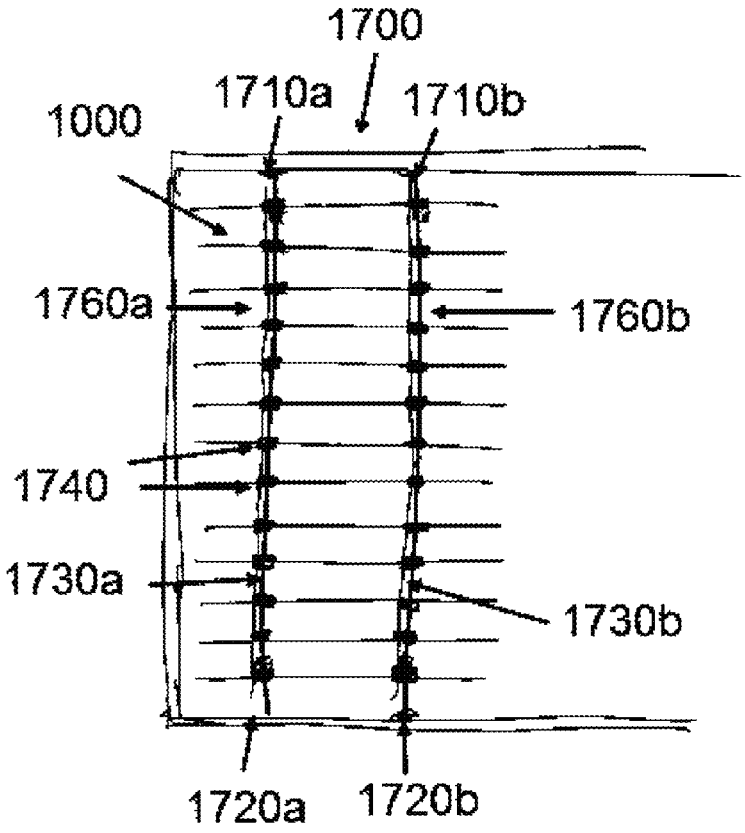
FIG. 10 shows a general view of further embodiments of a system for mounting the LED lighting device.

FIG. 10 shows a general view of further embodiments of a system 1700 for mounting the LED lighting device 1000 that will be described in more detail in FIGS. 11-18. The system shown comprises at least one top cable mount 1710 fixed to a top fixation point on a surface external to the mounting system 1700, at least one bottom cable mount 1720 fixed to a bottom fixation point on a surface external to the mounting system, and cables 1730 for tensioning, with each cable running from a top cable mount to a bottom cable mount. As shown, a set of elongated circuit boards 1020, each of which has mounting elements 1740 at regular intervals, are connected with electrical passageways 1750 (each element shown schematically only). When arranged as such, the mounting elements 1740 form two parallel columns 1760. A first of the cables 1730*a* is fixed to a first of the top mounting elements 1710*a* and bottom mounting elements 1720*a* and retains a first column 1760*a* of mounting elements 1740 and a second of the cables 1730*b* is fixed to a second of the top mounting elements 1710*b* and bottom mounting elements 1720*b* and retains a second column 1760*b* of mounting elements 1740. The LED lighting system 1000 may thereby be suspended on tensioned cables 1730.

It will be understood that while multiple cable mounts 1710, 1720 at the top and bottom of the LED lighting device 1000 are discussed, the device may be provided with a single top cable mount and a single bottom cable mount providing multiple connection points for mounting multiple tensioned cables. Similarly, the top and bottom cable mounts may be combined into a single chassis for tensioning a cable, such that the chassis may, for example, act as a stand, obviating the need for a top and bottom mounting surface.

Figure 11A:
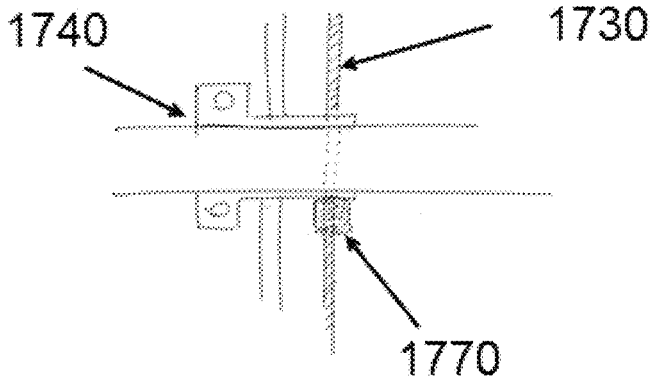
FIGS. 11A-C show gripping accessories for use with the mounting system of FIG. 10.
Figure 11B:
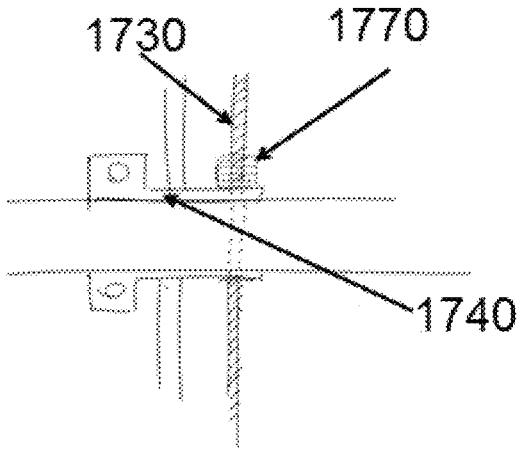
Figure 11C:
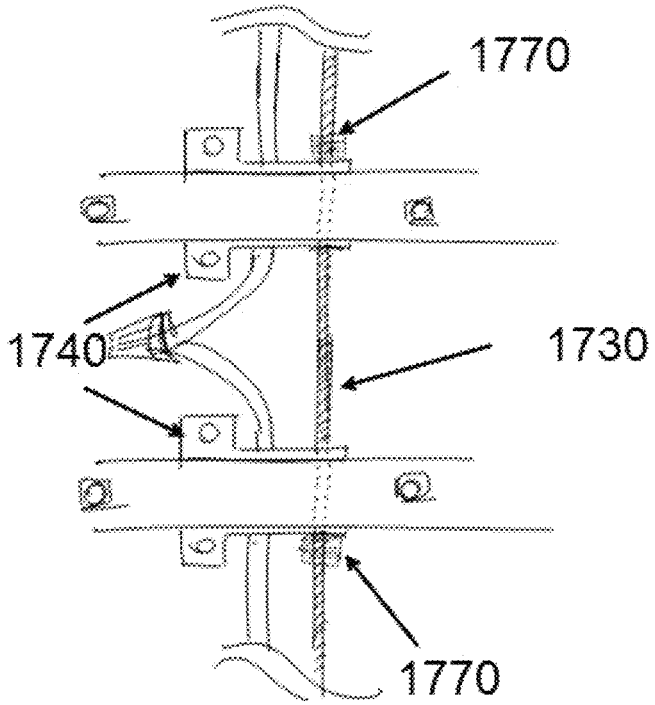

FIGS. 11A-C show gripping accessories 1770 for use with the mounting system of FIG. 10. The cables 1730 may be provided with gripping accessories 1770, which may be placed below a corresponding mounting element 1740 to provide support and prevent the mounting element from sliding along the corresponding cable 1730. Similarly, a gripping accessory 1770 may be placed above a mounting element 1740 to prevent the mounting element from riding up along the corresponding cable 1730. In some embodiments, only two gripping accessories 1770 are provided for each cable 1730 provided. Such gripping accessories are provided below the top mounting element 1740 and above the bottom mounting element. In other embodiments, additional gripping accessories 1770 are provided for additional stability, such as in the embodiment shown in FIG. 11C, where an electrical passageway is not available to ensure consistent spacing. Gripping accessories 1770 may be, for example, rubber grips, or they may be clips that may be fixed to the tensioned cable once all mounting elements are in place.

Several variations of mounting elements for use with the tensioned cable 1730 mounting system shown in FIG. 10. While certain variations, configurations, and methods for installing are discussed explicitly, it will be understood that alternatives are contemplated. For example, while mounting elements may be threaded onto the cable 1730 prior to installing the cable, the elongated circuit boards 1020 may be fixed to those mounting elements before or after the tensioning of the cables.

Figure 12A:
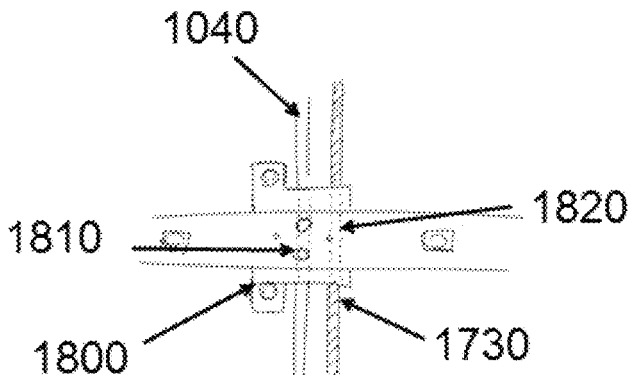
FIGS. 12A-B show one embodiment of a mounting element configured to mount on a cable according to FIG. 10.
Figure 12B:
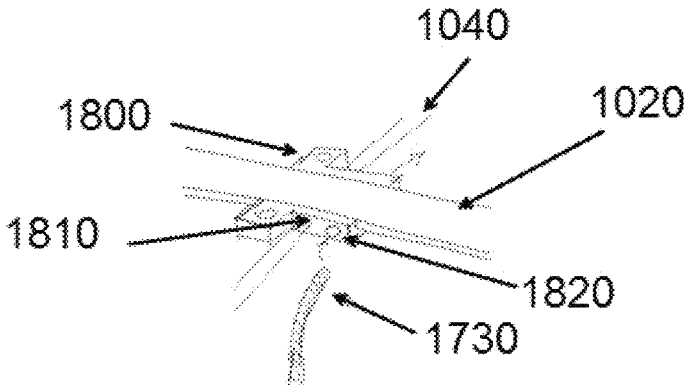

FIGS. 12A-B show one embodiment of a mounting element 1800 configured to mount on a cable 1730 according to FIG. 10. The mounting element 1800 may contain a first bore 1810 for an electrical passageway 1040, configured such that electrical connections may be made between the electrical passageway and the elongated circuit board 1020, and a second bore 1820 for the cable 1730. The bores 1810, 1820 may be parallel to each other such that the electrical passageway 1040 and the cable run parallel to each other. The mounting elements 1800 may be mounted on the cable 1730 prior to tensioning the cable between the top and bottom cable mounts 1710, 1720 by threading the tensioned cable 1730 through the second bore 1820 of each mounting element, along with any required gripping accessories 1770, as shown in FIG. 12. After all mounting elements are threaded onto the cable 1730, it may be tensioned between the corresponding top cable mount 1710 and bottom cable mount 1720 to suspend the corresponding mounting elements 1800.

Figure 13:
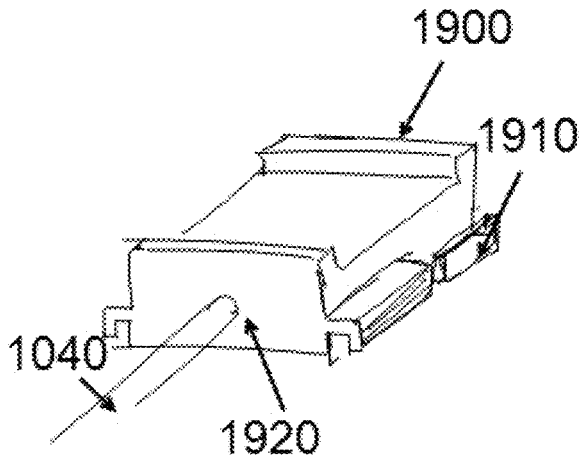
FIGS. 13-14 show an alternate embodiment of a mounting element configured to mount on a cable according to FIG. 10.
Figure 14:
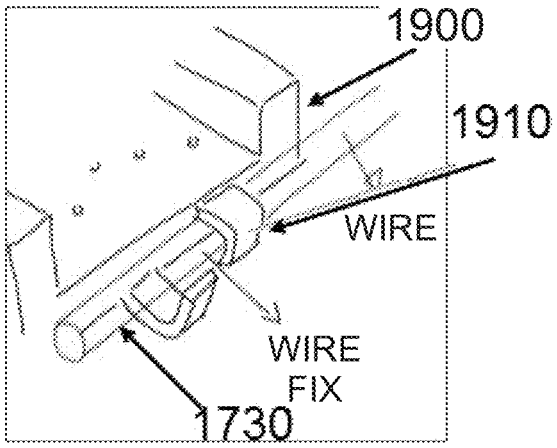

FIGS. 13-14 show an alternate embodiment of a mounting element 1900 configured to mount on a cable 1730 according to FIG. 10. The mounting element may be provided with side hooks 1910 designed to grip the cable 1730. While two side hooks 1910 are shown, it will be understood that in some embodiments only a single hook will be required to grip the cable 1730. Further, various gripping systems are contemplated, such that the hook may be, for example, a clip designed to grasp the cable. Mounting elements may then have only a single bore 1920 for retaining the electrical passage 1040, and the system may be installed by first tensioning the cable 1730 as needed, and only then mounting the mounting elements 1900 on the cable by way of the hooks 1910.

Figure 15:
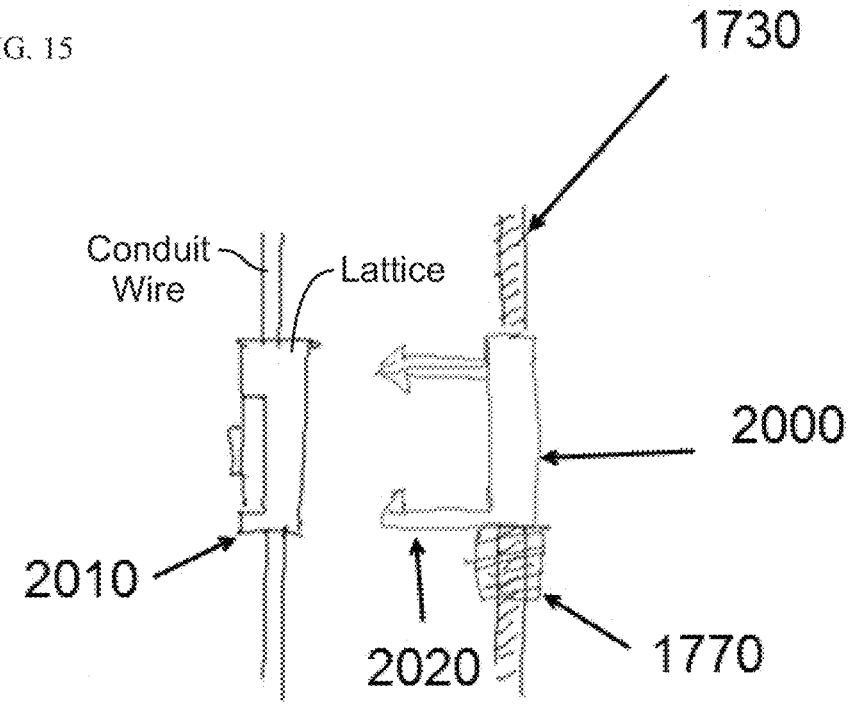
FIGS. 15-16 show a clip for gripping a mounting element designed to be mounted on a cable according to FIG. 10.
Figure 16:
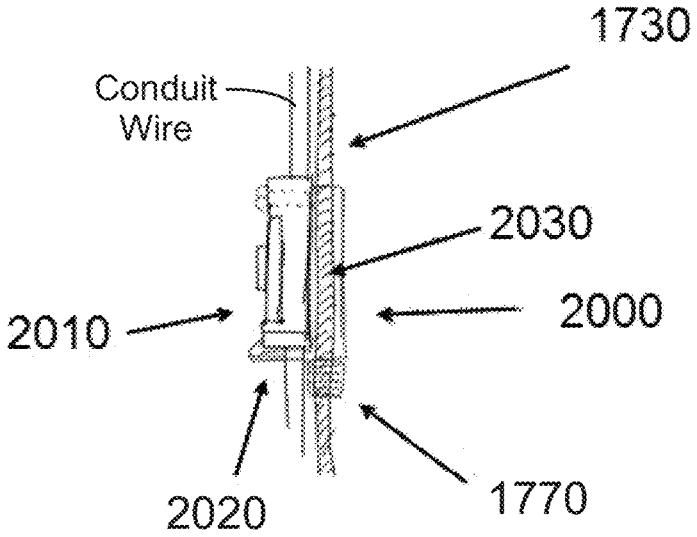

FIGS. 15-16 show a clip 2000 for gripping a mounting element 2010 mounted on a cable 1730 according to FIG. 10. A plurality of clips 2000 may be provided, and are configured with at least one tab 2020 for engaging with a mounting element 2100 as well as a bore 2030 for retaining the cable 1730. Each clip 2000 may further be provided with a gripping accessory 1770, as provided above, for maintaining the clips position along the cable 1730. Each clip 2000 may then be fixed to a cable 1730 prior to mounting the rest of the LED lighting device 1000. Once mounted, each clip 2000 may be mated to a corresponding mounting element 2010 at the at least one tab 2020. The tabs 2020 may be spring loaded tabs for grasping outer edges of the mounting elements 2010, or alternatively, may be spring loaded tabs for mating with a mounting hole of the corresponding mounting element. It will be understood that the clip 2000 may be similar to the clips 1620 discussed above, and adaptable variations may be applied to the present clips as well.

To install the LED lighting device 1000 using the clips 2000, the clips are either threaded or preinstalled onto the cables. Where necessary, gripping accessories 1720 are applied to position the clips 2000 along the cable 1730. The cable 1730 are then tensioned between top and bottom cable mounts 1710, 1720, and the mounting elements 2010 are mated to corresponding clips 2000. It will be understood that not every mounting element 2010 must be mated to a clip 2000, but rather, a smaller number of clips may be provided for retaining mounting elements only, for example, at extremities of the LED lighting device 1000.

Figure 17:
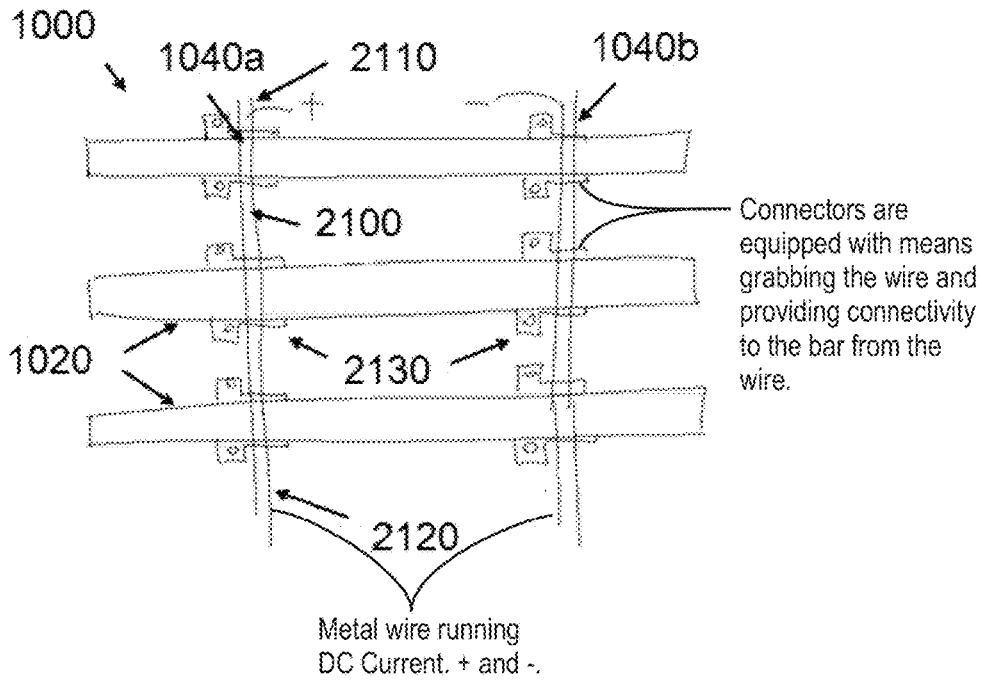
FIG. 17 shows an embodiment of an LED lighting device that may be mounted by tensioning the electrical passageways of the device.

FIG. 17 shows an embodiment of an LED lighting device 1000 that may be mounted by tensioning the electrical passageways 1040. In the embodiment shown, a first electrical passage 1040*a* carries a positive current or voltage and a second electrical passage 1040*b* carries a negative current or voltage, for completing a circuit through the elongated circuit boards 1020. Each of the electrical passageways 1040 comprise at least one wire 2100 having a heavy enough gage to tension the electrical passageways 1040 by fixing a top end of the wire 2110 to a top cable mount 1710 and a bottom end 2120 of the wire to a bottom cable mount 1720. The electrical passageways are in electrical contact with a power source or drain at one or both of the top cable mount 1710 and the bottom cable mount 1720, thereby providing electrical power to the LED lighting device 1000. It will be understood that although the device is shown having a single positive electrical passage 1040 and a single negative electrical passage, any combination of conduits may be provided within the electrical passage, as discussed elsewhere in this disclosure, so long as at least one wire or combination of wires from each electrical passage is of a thick enough gage to support tensioning.

In order to install the LED lighting device 1000 of FIG. 17, the mounting elements 2130 may first be fixed to corresponding electrical passageways 1040 at intervals 2140 along the passageway. Once all mounting elements 2130 are placed along a corresponding electrical passageway 1040, the top end of the wire 2110 may be mechanically and electrically connected to a corresponding top cable mount 1710, and the bottom end of the wire 2120 may be physically connected, and electrically connected, if necessary, to a corresponding bottom cable mount 1720, and the electrical passageway may then be tensioned between the two mounts. Once all electrical passageways 1040 are in place, providing substantially parallel columns of mounting elements 2130, elongated circuit boards 1020 may be fixed to corresponding mounting elements.

Figure 18:
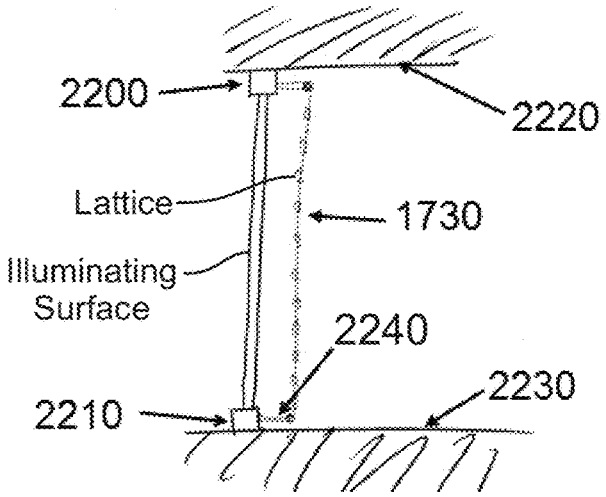
FIG. 18 illustrates an alternative embodiment of a tensioned LED lighting device having offset cable mounts.

In some implementations, the LED lighting device 1000 may be required in a location without a top or bottom surface for fixation of cable mounts 1710, 1720 according to FIG. 10. FIG. 18 illustrates an alternative embodiment of a tensioned LED lighting device 1000 having offset cable mounts 2200, 2210. A top cable mount 2200 is fixed to a surface, such as a ceiling 2220 or a wall, at the top of the installation of the LED lighting device 1000, and a bottom cable mount 2210 may be fixed to a surface, such as a floor 2230 or a wall, at the bottom of the installation of the LED lighting device. Each cable mount is provided with at least one offset arm 2240, which in turn grips the cable 1730 or electrical passageway 1040 to be tensioned between the cable mounts 2200, 2210.

In some embodiments, the elongated circuit board may be provided with multiple potential connection points for mechanically connecting to mounting elements 1060, and electrically connecting to electrical passageways 1040. The electrical passageways 1040 may carry different currents or voltages, such as a first electrical passageway 1040*a* carrying a positive current for connecting with an anode 1140 at one of a first set of connection points 2300 and a second electrical passageway 1040*b* carrying a negative current to connect with a cathode 1160 at one of a second set of connection points 2310. If electrical passageways 1040 are connected to an improper one of the connection points 2300, 2310, the LED lighting device may form a short across an elongated circuit board 1020, destroying the circuit board.

Figure 19A:
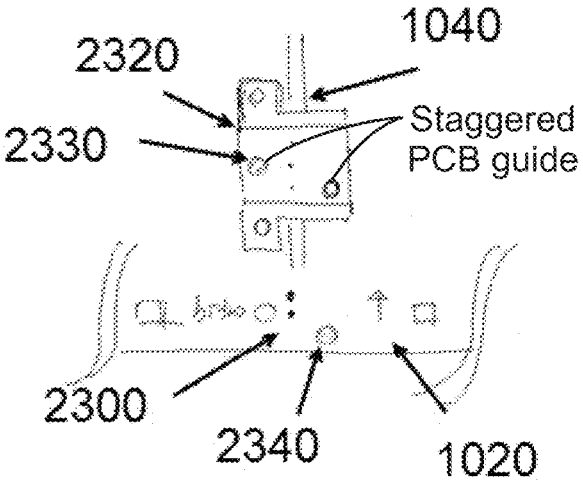
FIGS. 19A-B illustrate a mounting element containing an orientation element for preventing fixation to an inappropriate connection point.
Figure 19B:
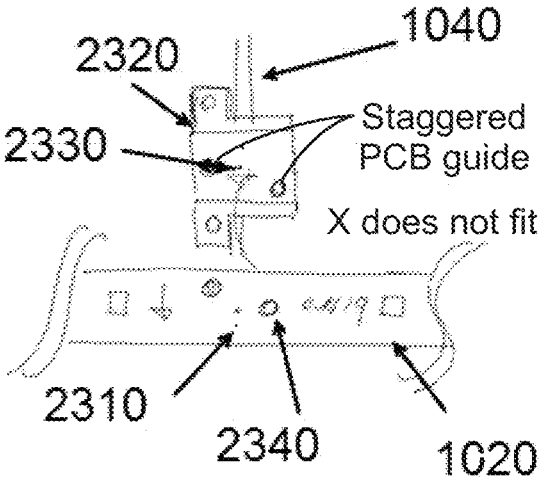

FIG. 19 illustrates a mounting element 2320 containing an orientation element 2330 for preventing fixation to an inappropriate connection point 2300, 2310. The orientation element 2330 may be, for example, one or more pins for mating with corresponding bores 2340 in the elongated circuit board 1020, such that each mounting element 2320 may only be fixed to the elongated circuit board in an appropriate location and with an appropriate orientation and positioning.

Figure 20A:
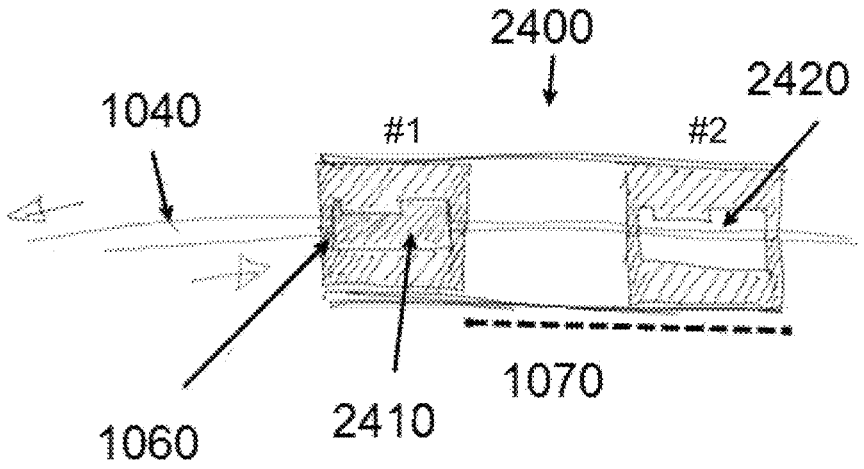
FIGS. 20A-C illustrate a jig and alternative production processes for consistently manufacturing LED lighting devices.

FIG. 20A illustrates a jig 2400 for manufacturing LED lighting devices 1000. When fixing mounting elements 1060 to electrical passageways 1040 at regular intervals 1070, the intervals are preferably consistent. Because several mounting elements 1060 are fixed to each electrical passageway 1040, and each mounting element supports an elongated circuit board 1020 in conjunction with a corresponding mounting element 1060 on a second electrical passageway 1040, even a slight variation between the intervals 1070 used on the first electrical passageway and those intervals used on the second electrical passageway are cumulative. For example, if 20 elongated circuit boards 1020 are provided in an LED lighting device 1000 and each mounting element 1060 has an error of 10 mm, the cumulative error would be 0.2 meters across the device. The jig 2400 provides a molding cavity 2410 and a gripping cavity 2420, each separated by the interval 1070 between two mounting elements 1060. In order to form the first mounting element 1060*a*, the electrical passageway is placed within the molding cavity 2410, and tensioned a known amount, and the first mounting element 1060*a* is formed around it. The first mounting element 1060*a* is then removed from the molding cavity 2410 and placed within the gripping cavity 2420. The electrical passageway then passes through the first mounting element 1060*a* and the molding cavity 2420, and is tensioned to the same amount as when forming the first mounting element 1060*a* while a second mounting element 1060*b* forms around it. The process is then repeated along the length of the electrical passageway 1040, with the second mounting element 1060*b* being placed in the gripping cavity 2420, the electrical passageway being passed through the molding cavity and tensioned a known amount, and additional mounting elements being formed.

The process is then repeated along a second electrical passageway, such that the intervals 1070 along the second electrical passageway are substantially identical as those along the first electrical passageway.

Figure 20B:
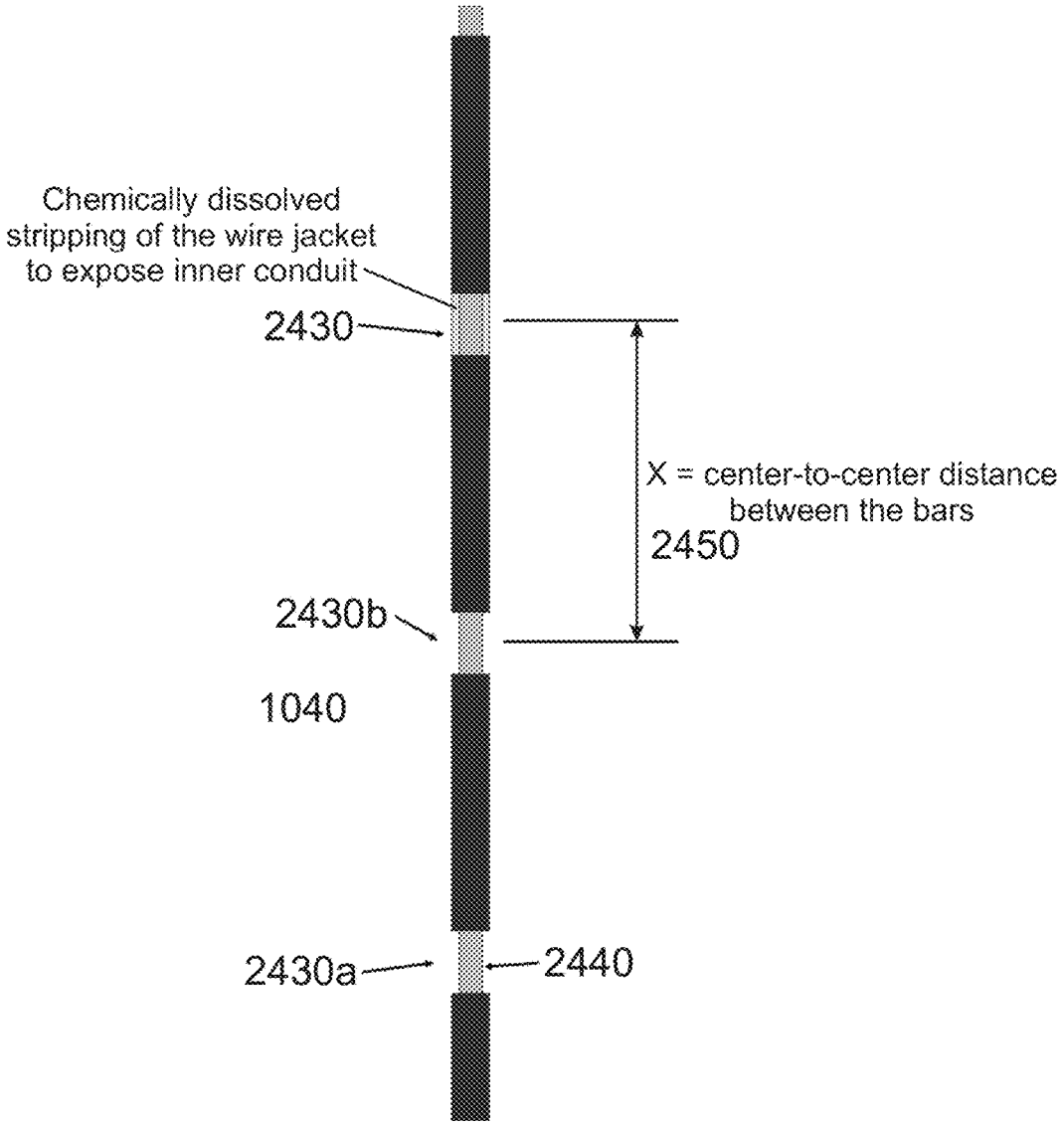

FIG. 20B illustrates an alternative method for ensuring consistent installation of the mounting elements 1060 on the electrical passageway 1040 by designating, in advance, exposed wire segments 2430 upon which the mounting elements 1060 are to be mounted. By accurately spacing the exposed wire segments 2430 prior to applying mounting elements 1060, the mounting elements can be installed only in the appropriate locations upon the electrical passageway 1040. This method is particularly effective where the mounting elements 1060 are to be fixed to the electrical passageway 1040 using solder 1172. In such an embodiment, a first wire segment 2430*a* is left exposed by stripping the wire jacket to expose the inner conduit 2440, and then measuring a center to center distance 2450 before stripping the wire jacket from a second wire segment 2430*b*.

Figure 20C:
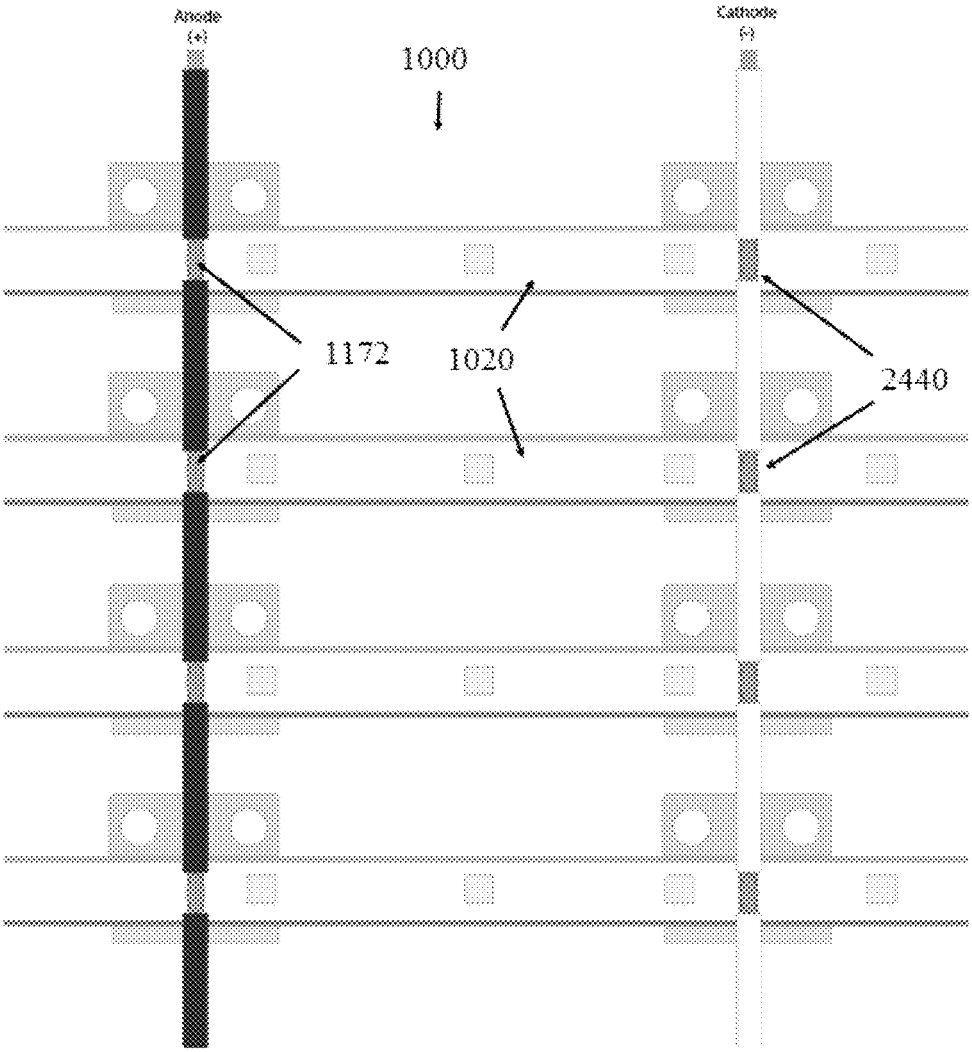

FIG. 20C illustrates an LED lighting device 1000 assembled using the method described in 20B. The exposed inner conduits 2440 are soldered to the elongated circuit boards 1020, resulting in equally spaced circuit boards. Alternatively, such a device can be assembled using a jig, such as that illustrated in FIG. 20A.

Figure 21A:
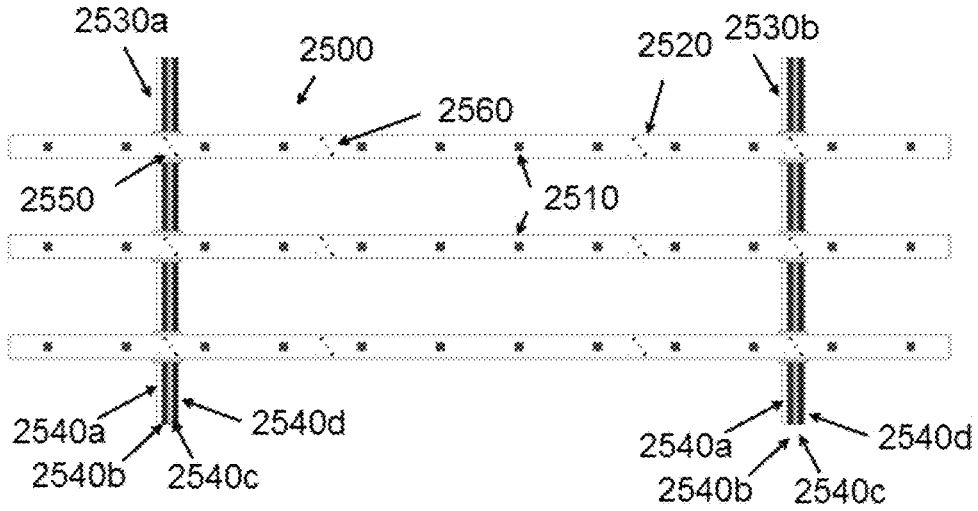
FIGS. 21A-C illustrate additional embodiments of LED lighting devices.
Figure 21B:
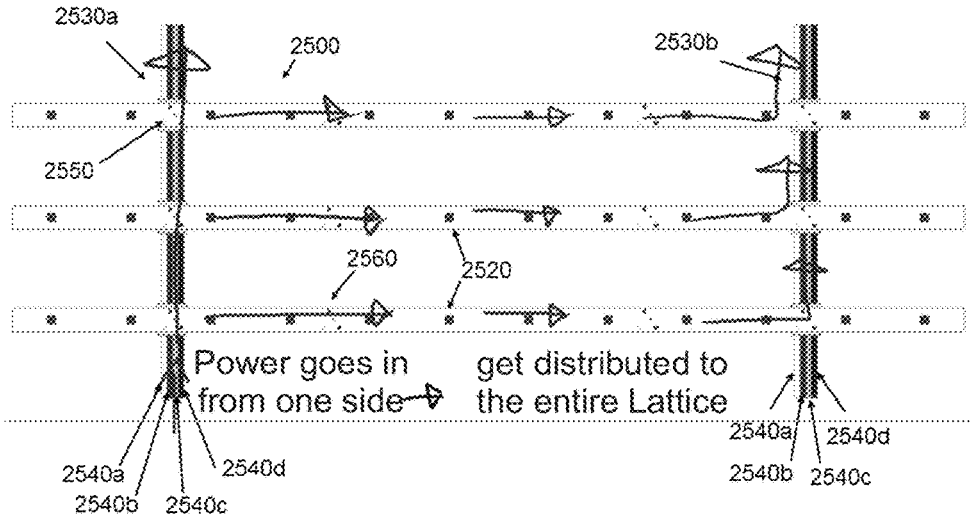
Figure 21C:
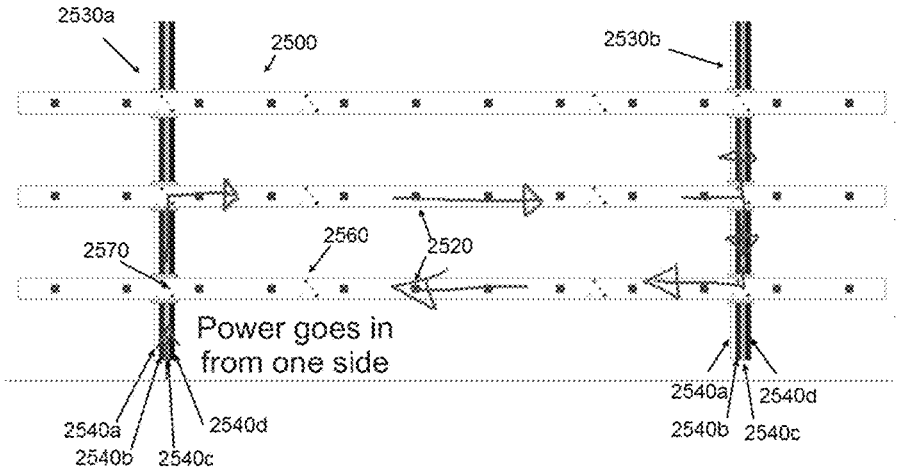

FIGS. 21A-C illustrate embodiments of an LED lighting system 2500 comprising a plurality of LED light sources 2510 disposed on each of a plurality of elongated circuit boards 2520, with the circuit boards coupled via electrical passageways 2530 to provide power. The electrical passageways 2530 each comprise four individual wires 2540 or groupings of wires, with a first wire 2540*a* from each set electrically connected to an anode on the elongated circuit board 2520 and with each of the three remaining wires 2540*b, c*, and *d*, connected to cathodes on the elongated circuit board, and each corresponding to a different color. Each wire 2540 on a first electrical passageway 2530*a* has a corresponding wire on a second electrical passageway 2530*b*

Each wire 2540 of each electrical passageway 2530 is electrically connected to the elongated circuit board 2520 at a corresponding connection point 2550*a-d*. The elongated circuit board may be provided with additional potential connection points 2560*a-d* to provide flexibility in assembling LED lighting system 2500. It will be understood that while two electrical passageways 2530 each containing four wires 2540 are shown, the LED lighting device 2500 may be provided with additional electrical passageways 2530 and/or additional wires 2540 for connecting to additional cathodes, or providing additional redundancy.

The use of at least two electrical passageways 2530 provides a redundancy for each wire 2540. Because corresponding wires 2540*a-d* are connected to each other across corresponding anodes or cathodes on each elongated circuit board, the LED lighting device 2500 may be powered by applying power to any one of the electrical passageways, as shown in the power distribution diagram shown in FIG. 21B. Once each anode and cathode of any of the elongated circuit boards 2520 is provided with power, any additional electrical passageways 2530 in electrical connection with the anode and cathodes may receive power from the connection points 2550.

Further, the redundancy provided by multiple electrical passageways 2530 with corresponding wires 2540*a-d* further allows the Led lighting device to continue to function in the event of a failed electrical connection at one of the connection points 2550. As shown in FIG. 21C, if a failed connection 2570 between a wire 2540*c* in the first elongated passageway 2530*a* and a first elongated circuit board 2520*a* is present in the system, power may still be carried by the corresponding wire 2540*c* to a second elongated circuit board 2520*b* to a corresponding wire 2540*c* in the second electrical passageway 2530*b*, which may in turn provide power to the corresponding cathode in the first elongated circuit board 2520*a*.

In the embodiment shown, the elongated circuit boards 2520 may be two sided PCBs, and each preferably has a width of less than 15 mm.

Figure 22:
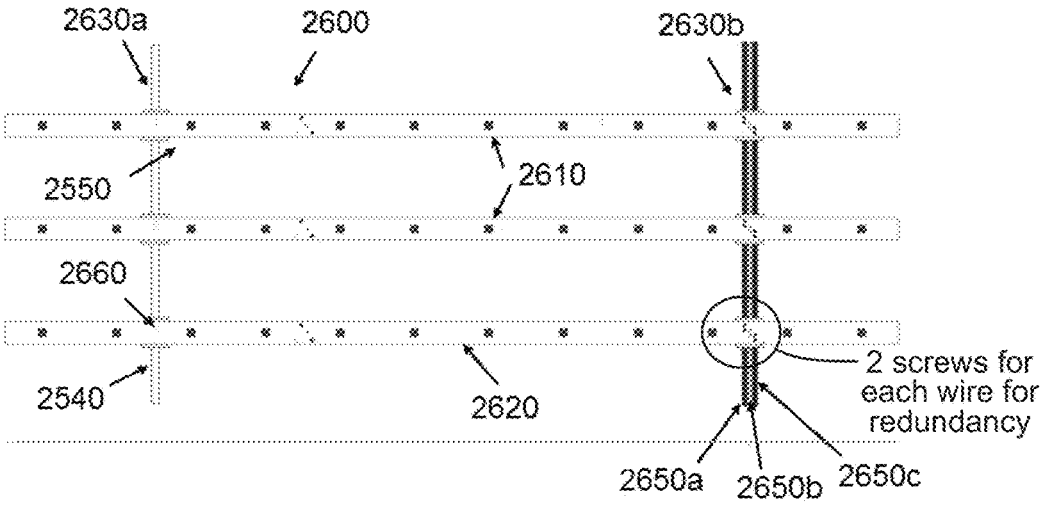
FIG. 22 illustrates an additional embodiment of an LED lighting device.

FIG. 22 illustrates an embodiment of an LED lighting system 2600 comprising a plurality of LED light sources 2610 disposed on each of a plurality of elongated circuit boards 2620, with the circuit boards coupled via electrical passageways 2630 to provide power. The first electrical passageway 2630*a* comprises a single wire 2640 electrically connected to an anode on each of the elongated circuit boards 2620 and the second electrical passageway 2630*b* comprises three individual wires 2650 or groupings of wires, with each of the three wires 2650*a-c* electrically connected to cathodes on each elongated circuit board, and each corresponding to a different color.

Contrary to the embodiments of FIG. 21, the first electrical passageway 2630*a* comprises wiring distinct from that contained in the second electrical passageway 2630*b*. The wire 2640 of the first electrical passageway 2630*a* is a common anode wire, providing power to the anode on each elongated circuit board 2620 of the embodiment. Similarly, the second electrical passageway 2630*b* provides power to each of three cathodes on each elongated circuit board. Separating the anode wire 2640 from the cathode wires 2650 dramatically reduces the possibility of a short circuit between the anode and a cathode.

Redundant connections 2660 are provided for each wire 2640, 2650 where the wire electrically connects to the elongated circuit boards 2620. In some embodiments, a third and fourth electrical passageway are provided, and are identical to and provide redundancies for the first and second electrical passageways 2630*a* and *b* respectively. It will be understood that additional electrical passageways may be provided, and that additional wires may be provided alongside the wires 2650 of the electrical passageways 2630 in order to provide electrical connections for additional cathodes in the system or to provide redundancies for the connections already described.

Figure 23A:
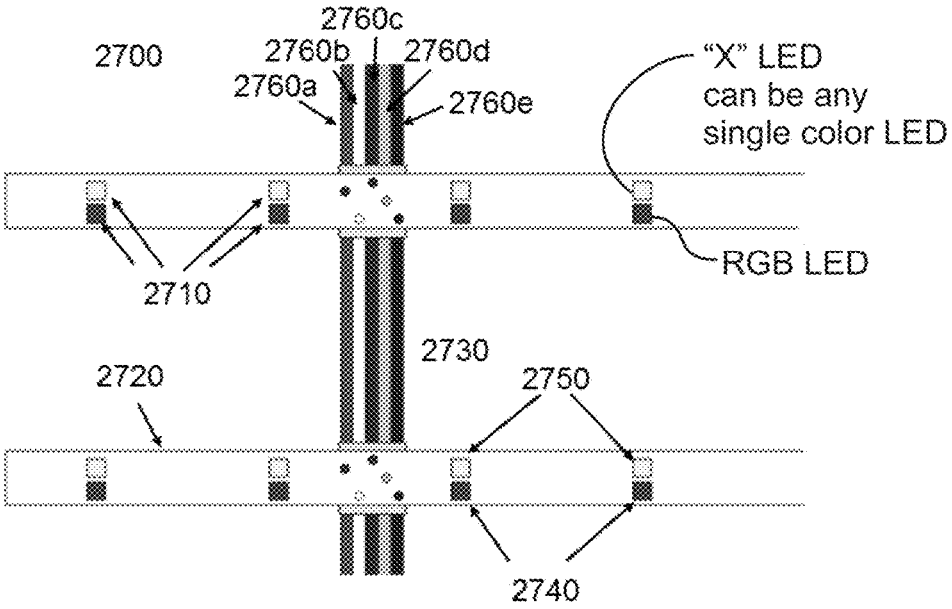
FIGS. 23A-C illustrate additional embodiments of LED lighting devices.
Figure 23B:
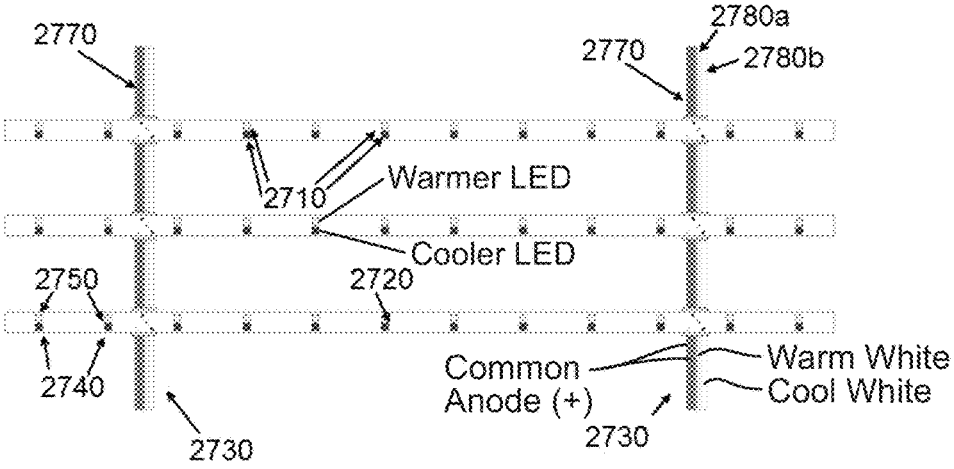
Figure 23C:
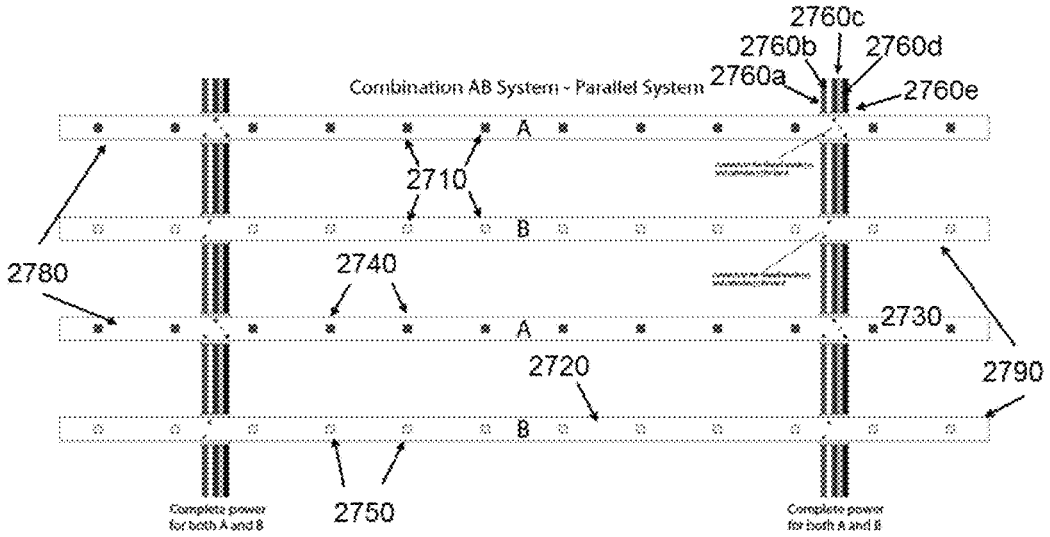

FIGS. 23A-C illustrate embodiments of an LED lighting device 2700 comprising a plurality of LED light sources 2710 disposed on each of a plurality of elongated circuit boards 2720, with the circuit boards coupled via electrical passageways 2730 to provide power. The LED light sources 2710 comprise a first set of LED light sources 2740 and a second set of LED light sources 2750, where each LED light source from the first set 2740*a* has a corresponding LED light source from the second set 2750*a*. As shown in FIG. 23A, the electrical passageways 2730 each comprise five individual wires 2760 or groupings of wires, with a first wire 2760*a* from each set electrically connected to an anode on the elongated circuit board 2720 and with each of three of the remaining wires 2760*b-d* connected to cathodes on the elongated circuit board, and each corresponding to a different color. The anode is connected to the three cathodes across the LED light sources 2710 from the first set 2740. The fifth wire 2760*e* connects to a fourth cathode on the elongated circuit board 2720 and the anode is connected to the fourth cathode across the LED light sources 2710 from the second set 2750. Each wire 2760*a-e* on a first electrical passageway 2730*a* has a corresponding wire on a second electrical passageway 2730*b*.

The LED light sources 2710 from the first set 2740 may be lit in a variety of colors by modifying the power provided to the three cathodes through wires 2760*b-d*. The LED light sources 2710 from the second set 2750 are configured to be lit in only a single color, such as a white light. When the LED lighting device 2700 is in use, LED light sources 2710 of one of the first set 2740 and the second set 2750 may be activated at different times, or in a programmed pattern, such that at any given time the lights in the first set or the lights from the second set are activated. The first set 2740 and the second set 2750 may be independently controlled, and may be lit simultaneously, consecutively, or independently.

As shown in FIG. 23B, the LED lighting device may be provided, at each electrical passageway 2730 with a common anode wire 2770 and two cathode wires 2780*a-b* connecting to a first cathode and a second cathode respectively. The anode on each elongated circuit board 2720 is electrically connected to the first cathode across an LED light source from the first set 2740 and connected to the second cathode across an LED light source from the second set 2750. The first set 2740 comprises LED light sources 2710 for providing a cool white light and the second set 2750 comprises LED light sources for providing a warm white light, compared to the LED light sources of the first set.

As shown in FIG. 23C, the plurality of elongated circuit boards 2720 may comprise a first set 2780 and a second set 2790. A first set 2740 of LED light sources 2710 may then be disposed on a first set 2780 of elongated circuit boards 2720 and a second set 2750 of LED light sources may then be disposed on a second set 2790 of elongated circuit boards. In such an embodiment, any cathodes associated with a first set 2740 of LED light sources are on only the first set 2780 of elongated circuit boards 2720 and any cathodes associated with the second set 2750 of LED light sources are on only the second set 2790 of elongated circuit boards.

It will be understood that the first electrical passageway 2730*a* and the second electrical passageways 2730*b* provide substantially identical wiring, thereby providing the redundancy benefits discussed above with respect to FIG. 21, and that the number and arrangement of wires 2760 may be modified in a similar manner.

FIGS. 24A-D illustrate embodiments of an LED lighting device 2800 comprising a plurality of LED light sources 2810 disposed on each of a plurality of elongated circuit boards 2820, with the circuit boards coupled via electrical passageways 2830 to provide power. The LED light sources 2810 comprise a first set of LED light sources 2840 and a second set of LED light sources 2850, where each LED light source from the first set 2840*a* has a corresponding LED light source from the second set 2850*a*.

The first electrical passageway 2830*a* comprises a single wire 2860 electrically connected to an anode on each of the elongated circuit boards 2820 and the second electrical passageway 2830*b* comprises four individual wires 2870 or groupings of wires, with each of a first three of the wires 2870*a-c* electrically connected to cathodes on each elongated circuit board, and each corresponding to a different color, and a fourth of the wires 2870*d* connected to a fourth cathode.

The anode is connected to the three cathodes electrically connected to the first three wires 2870*a-c* across the LED light sources 2810 from the first set 2840. The fourth 2870*d* wire in the second electrical passageway 2830*b* connects to a fourth cathode on the elongated circuit board 2820 and the anode is connected to the fourth cathode across the LED light sources 2810 from the second set 2850.

Figure 24A:
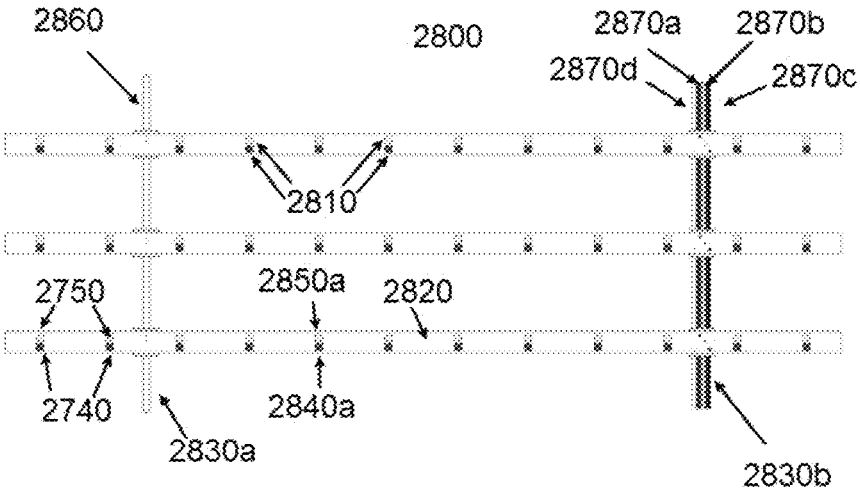
FIGS. 24A-D illustrate additional embodiments of LED lighting devices.
Figure 24B:
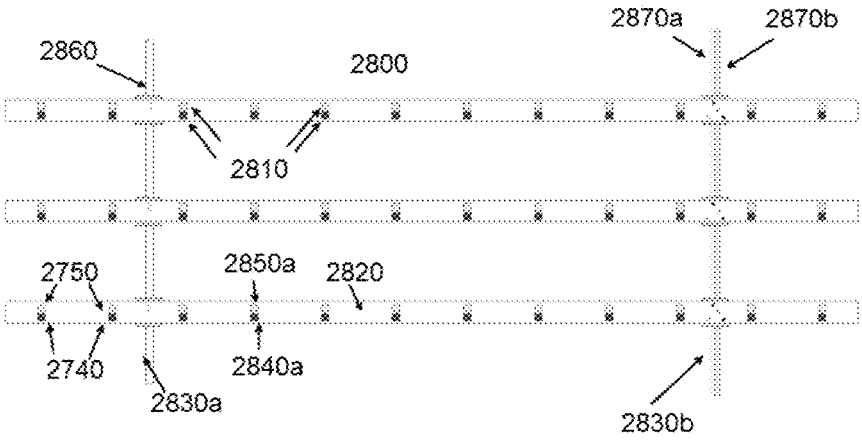

FIG. 24B provides a first electrical passageway 2830*a* comprising a first wire 2860 electrically connected to an anode on each elongated circuit board 2820, as in FIG. 24A, and a second electrical passageway 2830*b* comprising two wires 2870*a-b*, each electrically connected to a different cathode. The anode is connected to the first cathode across the LED light sources 2810 from the first set 2840 and the second cathode across the LED light sources 2810 from the second set 2850. In the embodiment shown, the two LED light sources provide light in two shades of white. In some alternative embodiments, the LED light sources may provide light in any other two colors. Similarly, where multiple colors are provided by different currents or voltages carried by anodes or cathodes, multiple shades of white may be provided as well. The first set 2840 comprises LED light sources 2810 for providing a cool white light and the second set 2850 comprises LED light sources for providing a warm white light, compared to the LED light sources of the first set.

Figure 24C:
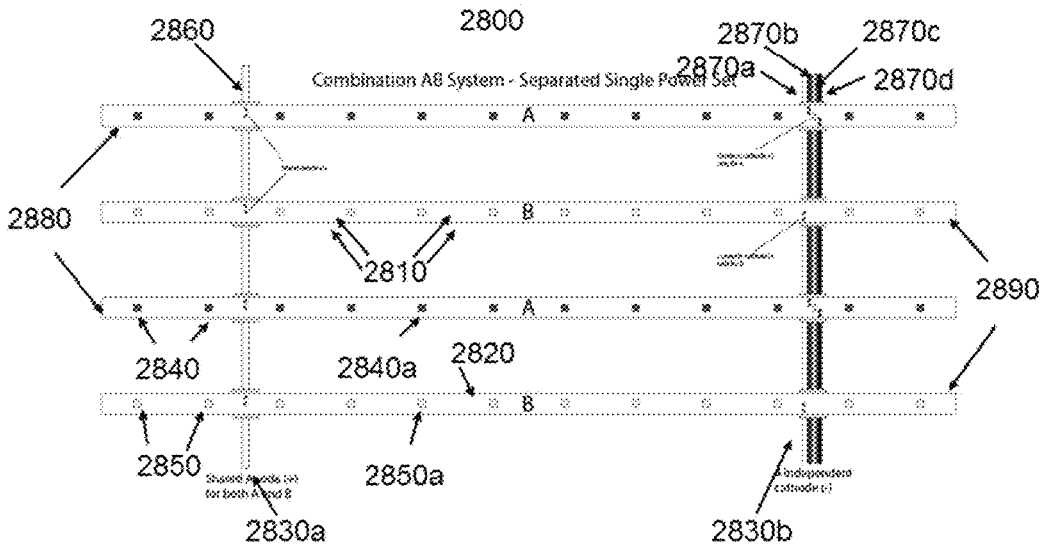

As shown in FIG. 24C, the plurality of elongated circuit boards 2820 may comprise a first set 2880 and a second set 2890. A first set 2840 of LED light sources 2810 may then be disposed on a first set 2880 of elongated circuit boards 2820 and a second set 2850 of LED light sources may then be disposed on a second set 2890 of elongated circuit boards. In such an embodiment, any cathodes associated with a first set 2840 of LED light sources are on only the first set 2880 of elongated circuit boards 2820 and any cathodes associated with the second set 2850 of LED light sources are on only the second set 2890 of elongated circuit boards.

The advantages and features provided by separating the anode wire 2860 from the cathode wires 2870 are similar to those described in relation to FIG. 22, and similar variations are contemplated. The advantages and features provided by providing and powering two sets of wires 2840, 2850 are similar to those described in relation to FIG. 23, and similar variations are contemplated.

Figure 24D:
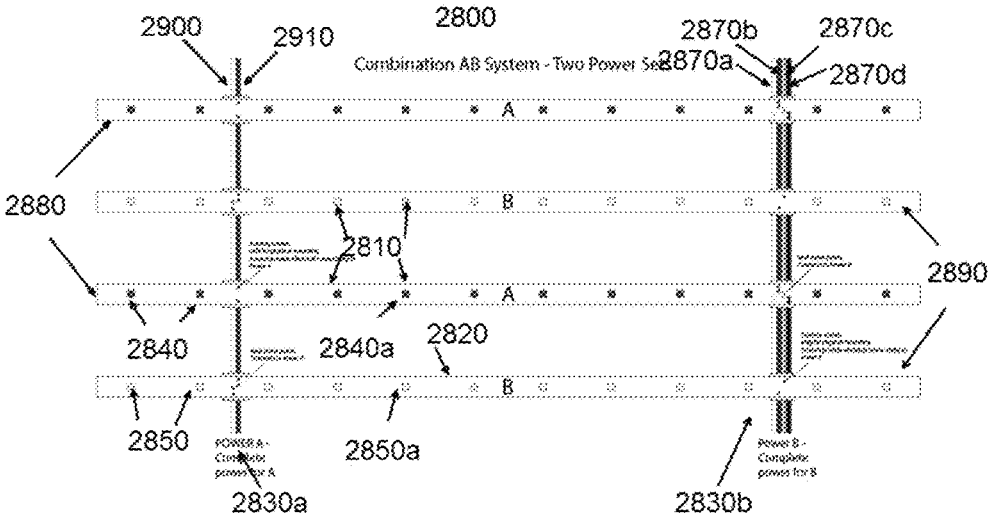

As shown in FIG. 24D, the first electrical passageway 2830*a* may be modified to contain two wires 2900, 2910. Rather than a common anode, a first wire 2900 connects to an anode on each elongated circuit board 2820 of a second set 2890 and a second wire 2910 connects to a cathode on each elongated circuit board of a second set 2890. A first set 2840 of LED light sources 2810 may then be disposed on the first set 2880 of elongated circuit boards 2820 and a second set 2850 of LED light sources may then be disposed on the second set 2890 of elongated circuit boards. The two wires in the first electrical passageway 2830*a* thereby provide a complete circuit for the second set 2890 of elongated circuit boards 2820.

Similarly, the wires in the second electrical passageway 2830*b* complete a circuit for the first set 2880 of elongated circuit boards 2820. A first wire 2870*a* from the second electrical passageway 2830*b* connects to an anode on the first set of elongated circuit boards 2820 and the remaining wires 2870*b-d* connect to cathodes, thereby completing a circuit across any LED light sources 2810 from the first set 2840 disposed on the corresponding elongated circuit board.

In such an embodiment, the anode associated with each elongated circuit board 2820 connects to any cathodes associated with that elongated circuit board across any LED light sources disposed on the associated elongated circuit board. In these embodiments, electrical connections with appropriate wires may be made using screws formed of conducting materials, as discussed above, and mechanical connections may be made with mounting elements where electrical connections are unwanted using dummy screws made of non-conducting materials.

Figure 25A:
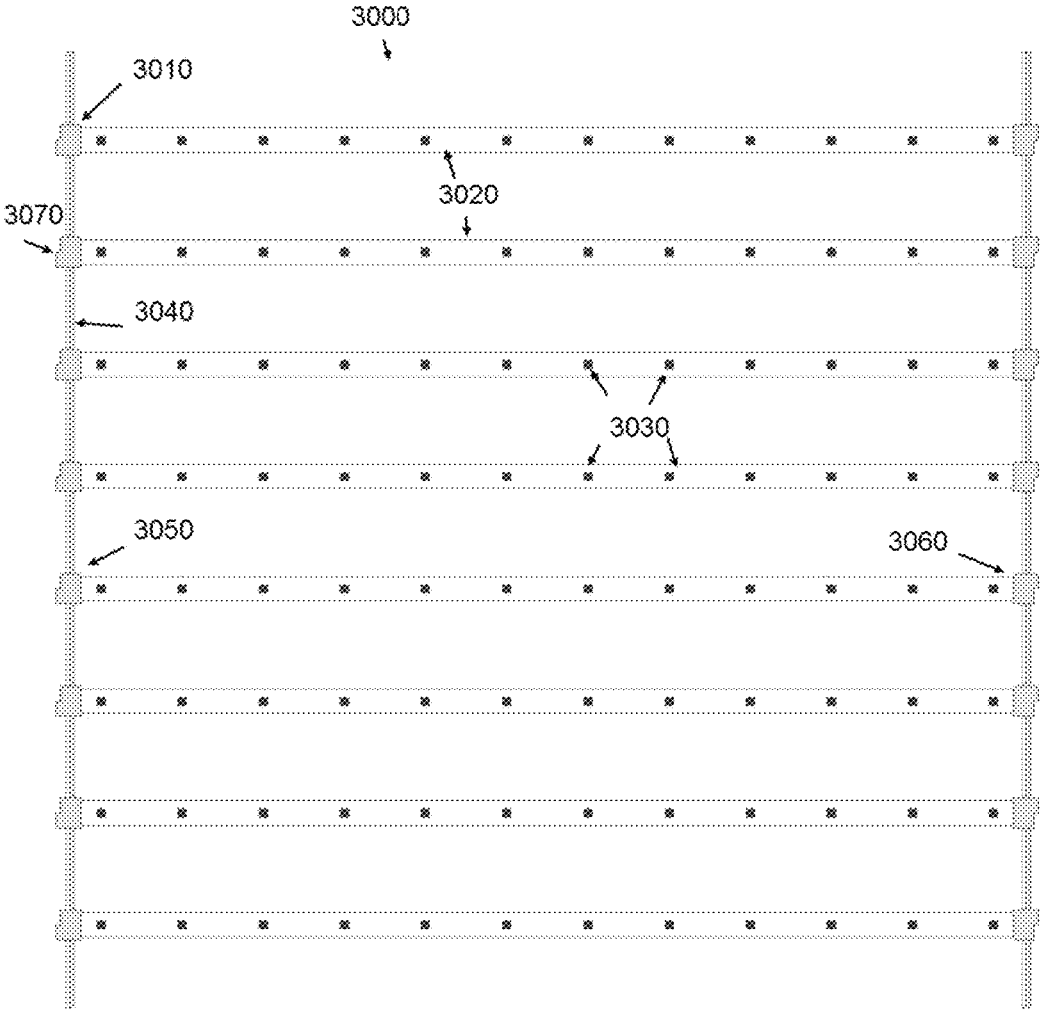
FIGS. 25A-C illustrate an LED lighting device having connectable mounting elements.
Figure 25B:
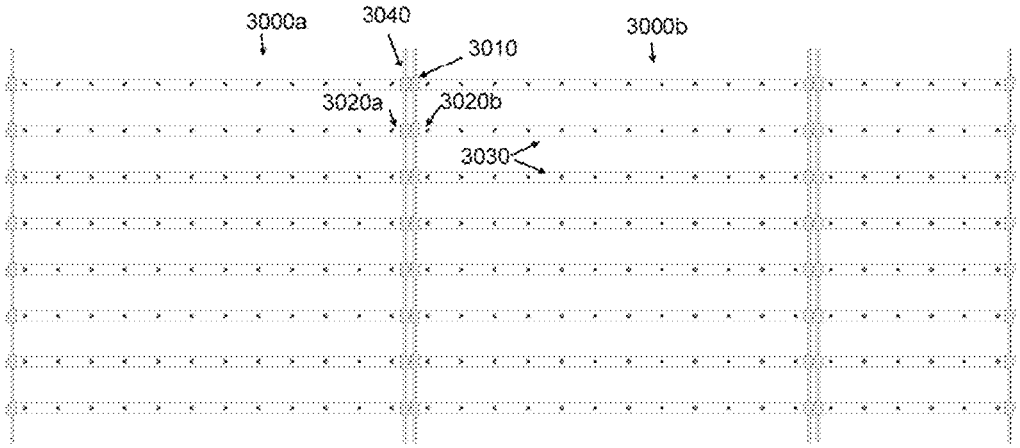
Figure 25C:
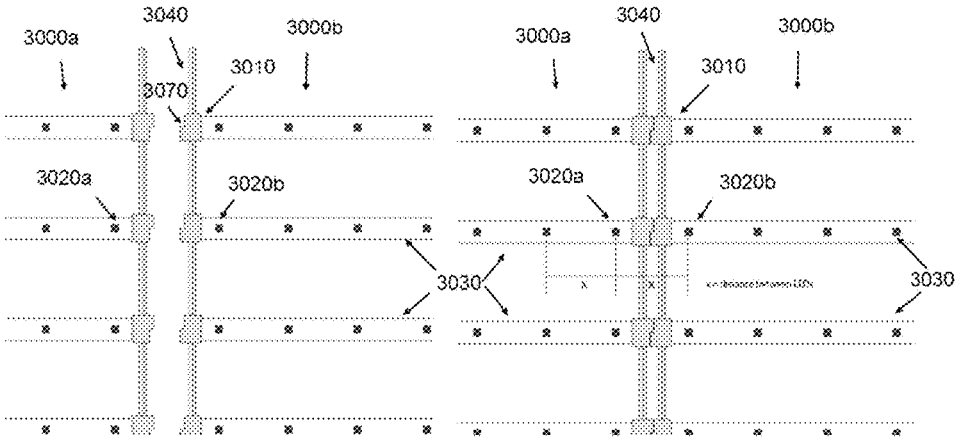

FIG. 25A-C illustrate an LED lighting device 3000 having connectable mounting elements 3010. The LED lighting system 3000 comprises a plurality of LED light sources 3020 disposed on each of a plurality of elongated circuit boards 3030, with the circuit boards coupled via electrical passageways 3040 to provide power. Each elongated circuit board 3030 has a first end 3050 and a second end 3060, and is electrically connected to each of the electrical passageways 3040 at one of the first end and the second end using a connectable mounting element 3010. The connectable mounting element may be fixed to an end of the elongated circuit board in any of the methods discussed elsewhere in this disclosure in relation to other mounting elements 1060.

Each connectable mounting element 3010 is provided with a clipping section 3070 configured to mate with a second connectable mounting element 3010 with a compatible clipping section 3070. As shown in FIGS. 25B and C, the connectable mounting element may be used to mate two or more LED lighting devices 3000 such that the distance from the last LED light source 3020*a* on a first LED lighting device 3000*a* is the same distance from the first LED light source 3020*b* on a second LED lighting device 3000*b* as it is from its neighboring LED light source along its corresponding elongated circuit board 3030.

It will be understood that each connectable mounting element 3010 may be mounted onto an external surface in any of the methods discussed relative to other mounting elements 1060 elsewhere in this disclosure. Similarly, the electrical passageways 3040 passing through each of the connectable mounting elements 3010 may be any of the electrical passageways in any of the configurations discussed elsewhere in this disclosure.

The clipping section 3070 of each connectable mounting element 3010 may be a friction fit, a clip, or any other fixation system for connecting two connectable mounting elements. In some embodiments, the connectable mounting element 3010 is fitted with electrical contacts for providing power from the first LED lighting device 3000*a* to the second LED lighting device 3000*b*. In such an embodiment, each electrical contact is associated with a corresponding wire within the corresponding electrical passageway 3040.

Figure 26A:
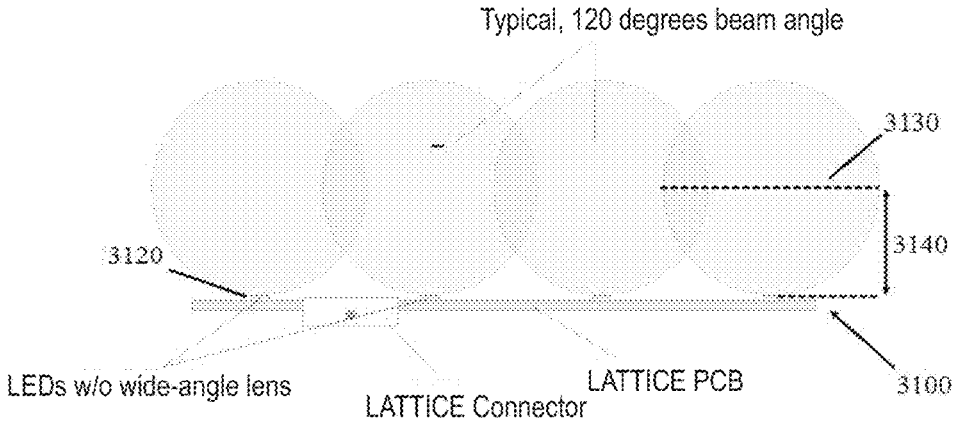
FIGS. 26A-B illustrate top views of embodiments of LED lighting devices with and without wide angle lenses.
Figure 26B:
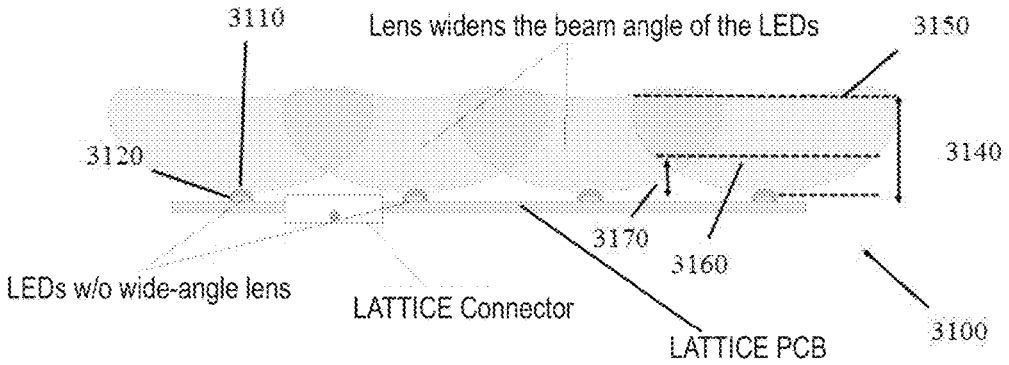

FIGS. 26A-B illustrate a top view of an LED lighting device 3100 with and without wide angle lenses 3110 applied to each LED light source 3120. In an LED lighting device 3100 without the wide angle lenses 3110 applied, as shown in FIG. 26A, light emitted from the LED light sources 3120 has a certain maximum beam angle, and they therefore provide a first beam coverage 3130 at a first distance 3140 from the LED light source. The beam angle of an LED light source 3120 is defined by the manufacturer of the LED package. A typical Surface Mounted Device (SMD) LED package has a 120 degree beam angle without any optics applied.

When an LED lighting device 3100 is provided with wide angle lenses 3110 for each LED light source 3120, as shown in FIG. 26B, a second beam coverage 3150 at the first distance 3140 is possible, with the second beam coverage being greater than the first beam coverage 3130 for each LED light source 3120. Additionally, the beam angle is increased so that the LED light source 3120 can provide a third beam coverage 3160 equal to the first beam coverage 3130 at a second distance 3170 shorter than the first distance 3140. Accordingly, when the wide angle lenses 3110 are applied, either the beam coverage may be expanded or the distance may be decreased. Accordingly, the application of the lenses may increase the uniformity of light distributed.

Figure 27A:
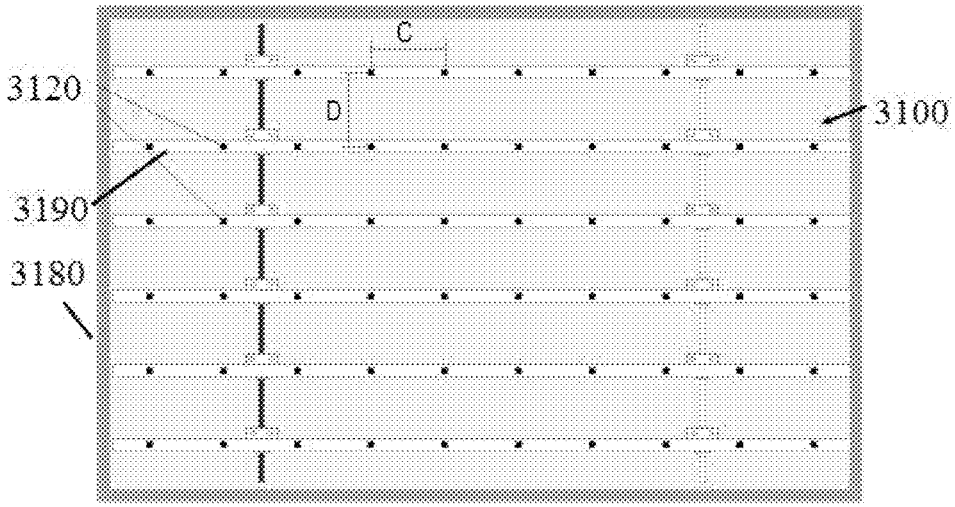
FIGS. 27A-F illustrate the use of LED lighting devices in light boxes.
Figure 27B:
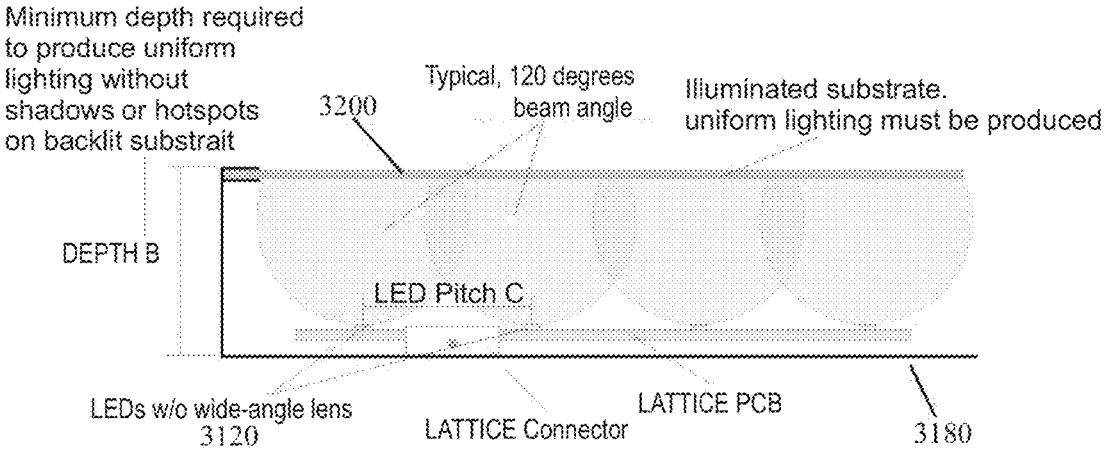

FIG. 27A-F illustrate the use of an LED lighting device 3100 in a light box 3180 configured to utilize each of the advantages discussed above with respect to FIGS. 26A-B. FIG. 27A shows a front view of an implementation of the LED lighting device 3100 in a light box 3180 without the wide angle lenses 3110 applied. In this embodiment, the LED light sources 3120 are spaced apart by an LED pitch C, or distance, along each elongated circuit board 3190. The LED light sources are spaced out by a bar to bar pitch D between the elongated circuit boards 3190. FIG. 27B shows a top view of the lighting device 3100 in the light box 3180, with the light box having an illuminated substrate 3200. The LED lighting device 3100, or in some cases, a reference relative to the LED lighting device, such as a surface for mounting, is separated from the illuminated substrate 3200 by a depth B. The depth B, the LED pitch C, and the bar to bar pitch D are each selected to provide a certain level of lighting uniformity on the illuminated substrate 3200. Accordingly, depth B is generally selected as the minimum depth to produce uniform lighting without shadows or hotspots.

Figure 27C:
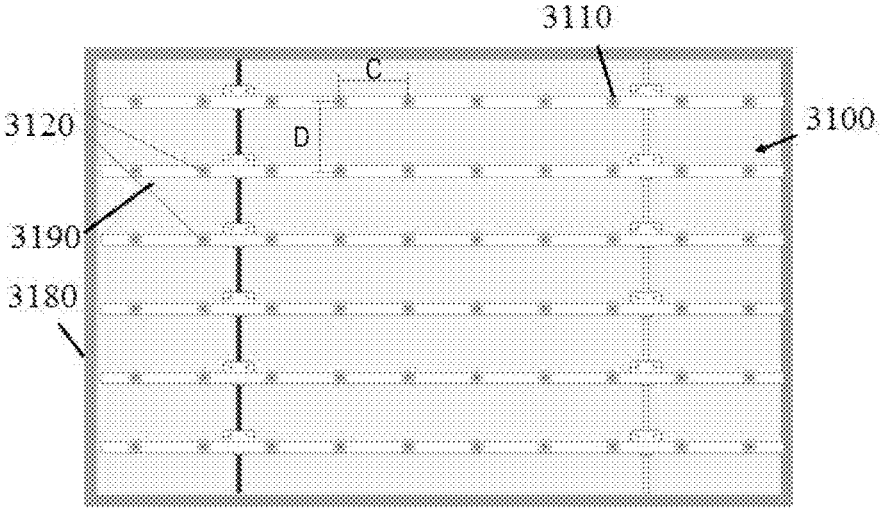
Figure 27D:
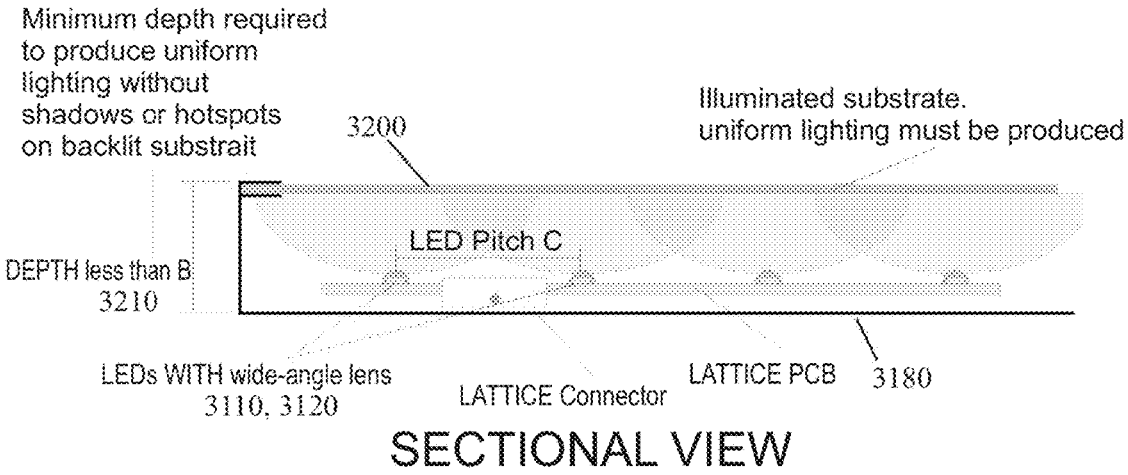

FIG. 27C-D show an implementation of the LED lighting device 3100 in a light box 3180 with wide angle lenses 3110 applied. In this embodiment, the LED light sources have the same LED pitch C and bar to bar pitch D as in the embodiment shown in FIG. 27A. However, because the lenses are applied, the depth 3210 is less than the depth B shown in FIG. 27B. Accordingly, the application of wide angle lenses 3110 allows the depth of a light box to be reduced.

Figure 27E:
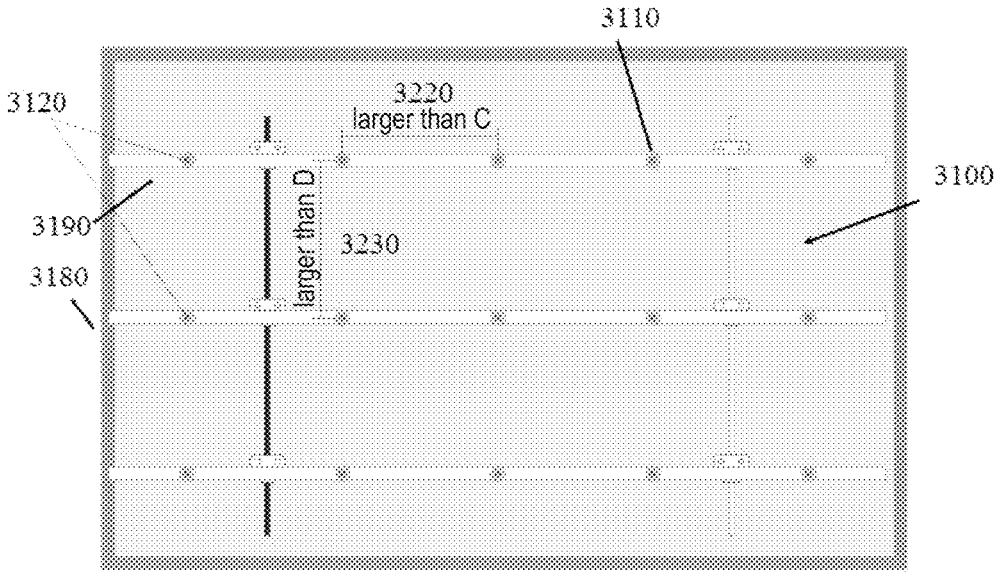
Figure 27F:
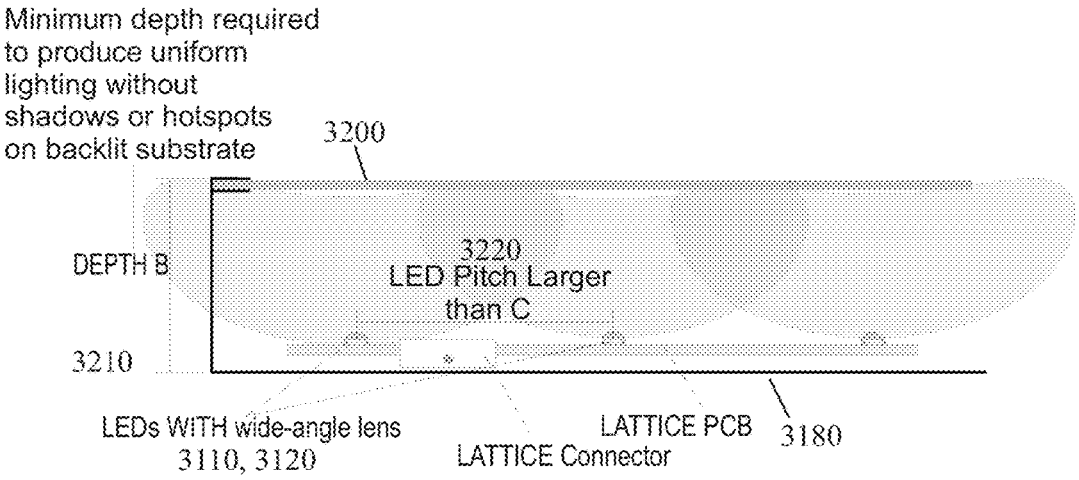

FIG. 27E-F show an alternative implementation of the LED lighting device 3100 in a light box 3180 with wide angle lenses 3110 applied. In the embodiment shown, the depth B is the same as in FIG. 27B. However, the LED pitch 3220 and the bar to bar pitch 3230 are greater than the LED pitch B and the bar to bar pitch C shown in FIG. 27A. Accordingly, the wide angle lenses 3110 allow the spacing between LED light sources 3120 to be increased without sacrificing uniformity at depth B. In this way, the number of LED light sources 3120 required, and the associated cost of manufacturing, may be reduced.

The embodiment shown in FIG. 27E-F allows for the use of fewer LED light sources and fewer elongated circuit boards to achieve the same level of uniformity in a given light box. In order to maintain the brightness level previously provided by additional LEDs, brighter LED light sources may be used.

As shown in FIG. 26-27, the application of wide angle lenses 3110 to LED light sources 3120 may be done by applying the lenses to each LED light source on the elongated circuit 3190 board individually. This may be done using a pick-and-place method, and the lenses may be bonded to the elongated circuit board 3190 using resin or a bonding chemical, or other permanent adhesion techniques. Using individual lenses allows for a variety of configurations without incurring multiples of the tooling costs for the lenses.

Figure 28:
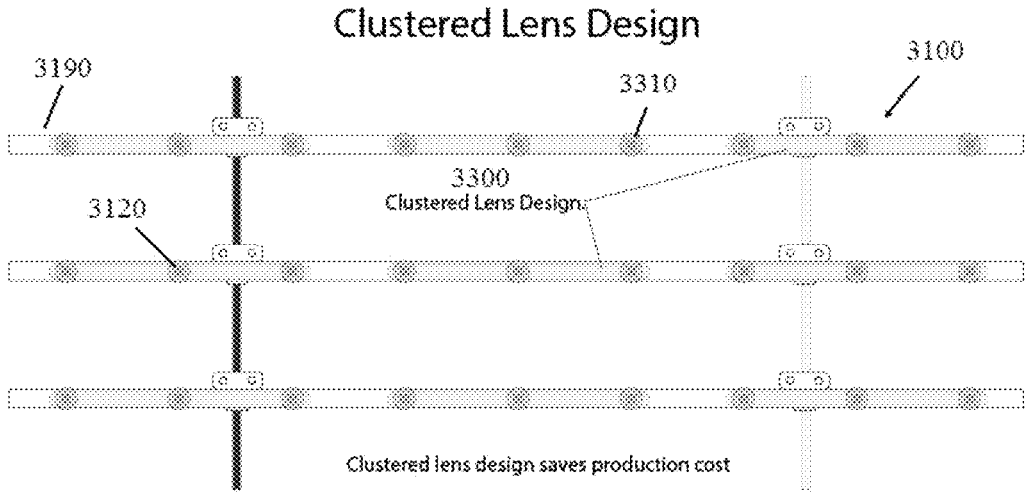
FIG. 28 illustrates an alternative embodiment of an LED lighting device with wide angle lenses.

FIG. 28 illustrates an alternative embodiment of the application of wide angle lenses 3300 to an elongated circuit board 3190 of the LED lighting device 3100. As shown, each of the wide angle lenses 3300 is configured to cover multiple LED light sources 3120, and provide a lens segment 3310 for each light source. To optimize the cost of the lenses and reduce assembly time, the wide angle lenses 3300 may then provide efficiently manufactured clusters of lens segments 3310.

Figure 29:
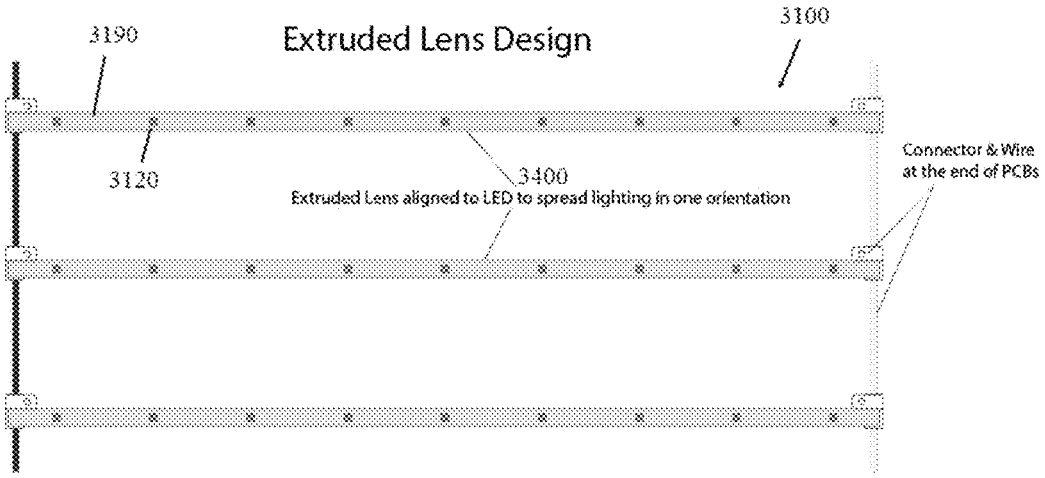
FIG. 29 illustrates an alternative embodiment of an LED lighting device with wide angle lenses.

FIG. 29 illustrates an alternative embodiment of the application of wide angle lenses 3400 to an elongated circuit board 3190 of the LED lighting device 3100. As shown, each of the wide angle lenses 3400 covers multiple LED light sources 3120. Further, providing a single elongated lens 3400 allows the lens to be produced by an extrusion process, which allows the lenses to be inexpensively manufactured for a variety of elongated circuit board 3190 lengths.

In the embodiment shown in FIG. 29, the lens may only widen the distribution of light in a single dimension, as the lens would be an extrusion of a two dimensional cross section. Accordingly, in some embodiments, the bar to bar pitch in some embodiments may be extended, but the LED pitch may remain the same as would be provided without the lens.

In some embodiments, the elongated circuit boards are provided with an aluminum profile base design, and the elongated circuit boards and the LED light sources are placed in an aluminum channel. Connecters required for the circuits are then placed on the edges.

While certain embodiments have been described at some length and with some particularity, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope.

What is claimed is:

1. A light emitting diode (LED) lighting device comprising:

a plurality of LED light sources disposed on each of two or more elongated circuit boards, each LED light source of the plurality of LED light sources being electrically connected to one of the two or more elongated circuit boards, the two or more elongated circuit boards electrically coupled to provide power to the circuit boards, wherein the two or more elongated circuit boards are electrically coupled at intervals along the length of the elongated circuit boards using two or more electrical passageways each connected to power or ground external to the elongated circuit boards, the two or more elongated circuit boards electrically coupled at intervals along the electrical passageways, wherein each of the two or more elongated circuit boards is a single sided printed circuit board arranged side by side lengthwise and substantially in parallel with each other, and a first electrical wire in a first of the two or more electrical passageways connects to a cathode on each elongated circuit board and a second electrical wire in a second of the two or more electrical passageways connects to an anode on each elongated circuit board, wherein the plurality of LED light sources disposed on each of two or more elongated circuit boards emit light in the same direction perpendicular to the elongated circuit boards, and wherein each of the two or more electrical passageways is connected to each of the two or more elongated circuit boards by at least one electrically conductive screw or pin that passes through the circuit board and connects a portion of a first electrically conductive layer to an electrical wire on the opposite unprinted side of a substrate on each elongated circuit board.

2. The device of claim 1 further comprising a plurality of mounting elements fixed to each of the two or more electrical passageways at regular intervals, the plurality of mounting elements configured for connecting to the two or more elongated circuit boards.

3. The device of claim 2 wherein each of the plurality of mounting elements further comprises wings for engaging a track for locating the elongated circuit boards in relation to each other.

4. The device of claim 2 further comprising a plurality of secondary mounting clips for fixing the device to fixation points external to the device, each mounting clip comprising an engagement element for engaging one of the plurality of mounting elements.

5. The device of claim 2 further comprising:

a top cable mount separate from the elongated circuit boards;

a bottom cable mount separate from the elongated circuit boards; and a plurality of tensioned cables each fixed to both the top cable mount and the bottom cable mount, wherein each of the plurality of mounting elements further comprises a channel for retaining one of the plurality of tensioned cables, the channel substantially parallel to the corresponding electrical passageway of the two or more electrical passageways for the mounting element.

6. The device of claim 2 further comprising:

a top cable mount separate from the elongated circuit boards; and a bottom cable mount separate from the elongated circuit boards, and wherein the two or more electrical passageways are tensioned and fixed to the top cable mount and the bottom cable mount.

7. The device of claim 2, each mounting element of the plurality of mounting elements further comprising at least one mount orientation element for mating with a corresponding circuit board orientation element on one of the two or more elongated circuit boards and limiting the connection between the mounting element and the corresponding elongated circuit board to one or more predetermined configurations.

8. The device of claim 1, wherein the anode is adjacent a first edge of the corresponding elongated circuit boards, and the cathode is adjacent a second edge of the corresponding elongated circuit boards, the device further comprising:

circuitry connecting the anode and the cathode to each of the plurality of LED light sources on the corresponding elongated circuit board.

9. The device of claim 8, wherein the circuitry is located on a surface of the corresponding elongated circuit boards.

10. The device of claim 1, wherein the two or more elongated circuit boards comprise three or more elongated circuit boards.

11. A light emitting diode (LED) lighting device comprising:

a plurality of LED light sources disposed on each of two or more elongated circuit boards, each LED light source of the plurality of LED light sources being electrically connected to one of the two or more elongated circuit boards, the two or more elongated circuit boards electrically coupled to provide power to the circuit boards; and a plurality of wide angle lenses mounted on the plurality of LED light sources, wherein the two or more elongated circuit boards are arranged side by side lengthwise and substantially in parallel with each other and are electrically coupled at intervals along the length of the elongated circuit boards using two or more electrical passageways each connected to power or ground, the two or more elongated circuit boards electrically coupled at intervals along the electrical passageways, wherein the plurality of LED light sources disposed on each of two or more elongated circuit boards emit light in the same direction perpendicular to the elongated circuit boards, wherein light emitted from each LED light source passes through one of the wide angle lenses and wherein each of the two or more electrical passageways is connected to each of the two or more elongated circuit boards by at least one electrically conductive screw or pin that passes through the circuit board and connects a portion of a first electrically conductive layer to an electrical wire on the opposite unprinted side of a substrate on each elongated circuit board.

12. The device of claim 11, wherein each of the plurality of wide angle lenses covers multiple of the plurality of LED light sources.

13. The device of claim 12, wherein each of the plurality of wide angle lenses widens the distribution of light in a single dimension.

14. The device of claim 13, wherein each of the plurality of wide angle lenses is an extrusion of a two dimensional cross-section.

15. The device of claim 14, wherein the plurality of LED light sources on the surface of a single one of the elongated circuit boards are closer together than the elongated circuit boards are to each other.

16. The device of claim 11, wherein the two or more elongated circuit boards comprise three or more elongated circuit boards.

17. A light emitting diode (LED) lighting device comprising:

a plurality of LED light sources disposed on each of two or more elongated circuit boards, each LED light source of the plurality of LED light sources being electrically connected to one of the two or more elongated circuit boards, the two or more elongated circuit boards electrically coupled to provide power to the circuit boards, wherein the two or more elongated circuit boards are electrically coupled at intervals along the length of the elongated circuit boards using two or more electrical passageways each connected to power or ground external to the elongated circuit boards, the two or more elongated circuit boards electrically coupled at intervals along the electrical passageways, wherein each of the two or more elongated circuit boards is a single sided printed circuit board arranged side by side lengthwise and substantially in parallel with each other, and a first electrical wire in a first of the two or more electrical passageways connects to a cathode on each elongated circuit board and a second electrical wire in a second of the two or more electrical passageways connects to an anode on each elongated circuit board, wherein the plurality of LED light sources disposed on each of two or more elongated circuit boards emit light in the same direction perpendicular to the elongated circuit boards, and further comprising:

circuitry connecting the anode and the cathode to each of the plurality of LED light sources on the corresponding elongated circuit board, wherein the anode is adjacent a first edge along a length of the corresponding elongated circuit boards, and the cathode is adjacent a second edge along the length of the corresponding elongated circuit boards.

18. The device of claim 17, wherein the circuitry is located on a surface of the corresponding elongated circuit boards.

* * * * *